US008840075B2

(12) United States Patent
Dalebout et al.

(10) Patent No.: US 8,840,075 B2
(45) Date of Patent: Sep. 23, 2014

(54) DOOR MOUNTED EXERCISE DEVICES AND SYSTEMS

(75) Inventors: William Dalebout, North Logan, UT (US); Michael Olson, Logan, UT (US)

(73) Assignee: ICON IP, Inc., Logan, UT (US)

( * ) Notice: Subject to any disclaimer, the term of this patent is extended or adjusted under 35 U.S.C. 154(b) by 595 days.

(21) Appl. No.: 12/878,923

(22) Filed: Sep. 9, 2010

(65) Prior Publication Data

US 2011/0177921 A1 Jul. 21, 2011

Related U.S. Application Data

(63) Continuation-in-part of application No. 29/354,089, filed on Jan. 19, 2010, now Pat. No. Des. 650,451.

(51) Int. Cl.

| | |
|---|---|
| ***A63B 21/04*** | (2006.01) |
| ***A63B 21/02*** | (2006.01) |
| ***A63B 21/00*** | (2006.01) |
| ***A63B 21/16*** | (2006.01) |
| ***A63B 23/035*** | (2006.01) |
| ***A63B 21/055*** | (2006.01) |

(52) U.S. Cl.

CPC ..... *A63B 21/1645* (2013.01); *A63B 21/00065* (2013.01); *A63B 21/154* (2013.01); *A63B 23/03575* (2013.01); *A63B 21/1469* (2013.01); *A63B 2210/50* (2013.01); *A63B 23/03541* (2013.01); *A63B 21/0442* (2013.01); *A63B 21/1426* (2013.01); *A63B 21/0552* (2013.01); *Y10S 482/904* (2013.01)

USPC ..... 248/214; 248/200; 248/300; 248/304; 482/121; 482/129; 482/904

(58) Field of Classification Search

USPC ..... 248/200, 214, 300, 301, 304; 482/92, 482/94, 96, 121, 124, 125, 126, 129, 131, 482/904

See application file for complete search history.

(56) References Cited

U.S. PATENT DOCUMENTS

| | | | | |
|---|---|---|---|---|
| 232,579 | A | 9/1880 | Weeks | |
| 325,435 | A | 9/1885 | North | |
| 685,788 | A | 11/1901 | McFadden | |
| 754,992 | A | 3/1904 | Grabner | |
| 761,504 | A | 5/1904 | Kleinbach | |
| 2,274,574 | A | 2/1942 | Zerne | |
| 2,512,417 | A * | 6/1950 | Cook | 248/315 |
| D182,660 | S | 4/1958 | Hastings | |

(Continued)

OTHER PUBLICATIONS

Photocopies of portions of Body by Jake, Tower 200 packaging, copyright 2009, 7 pages.

(Continued)

*Primary Examiner* — Anita M King

(74) *Attorney, Agent, or Firm* — Holland & Hart, LLP

(57) ABSTRACT

Systems, assemblies, and devices for mounting an exercise apparatus to a door. More particularly, an exercise system is mounted to opposing corners of a door and directed diagonally across a door. A bracket engages the door corner and is oriented to directed tension members of the exercise system at a diagonal across a front surface of the door. The bracket includes a door mount for coupling the bracket to four surfaces of the door. The bracket includes an exercise device mount adapted to couple to tension members, pulleys, or other exercise devices. The exercise device mount defines a mounting axis that is non-parallel and non-perpendicular relative to a top edge surface of the door.

16 Claims, 13 Drawing Sheets

(56) References Cited

U.S. PATENT DOCUMENTS

| | | | | |
|---|---|---|---|---|
| 2,938,695 | A * | 5/1960 | Ciampa | 248/214 |
| 3,118,441 | A | 1/1964 | George | |
| 3,256,630 | A * | 6/1966 | Spector | 40/790 |
| 3,652,085 | A | 3/1972 | Cole | |
| 4,059,265 | A | 11/1977 | Wieder et al. | |
| 4,073,490 | A | 2/1978 | Feather | |
| 4,328,964 | A | 5/1982 | Walls | |
| D264,862 | S | 6/1982 | Kokoska | |
| 4,428,578 | A | 1/1984 | Kilpatrick | |
| 4,463,948 | A | 8/1984 | Mohr | |
| D277,218 | S | 1/1985 | Hinds | |
| 4,606,541 | A | 8/1986 | Kilpatrick | |
| 4,611,805 | A | 9/1986 | Franklin et al. | |
| 4,685,670 | A | 8/1987 | Zinkin | |
| 4,685,671 | A | 8/1987 | Hagerman et al. | |
| 4,779,867 | A | 10/1988 | Hinds | |
| 4,830,365 | A | 5/1989 | March | |
| 4,844,448 | A | 7/1989 | Niznik | |
| 4,861,020 | A | 8/1989 | Soligny, Sr. | |
| 4,909,505 | A | 3/1990 | Tee | |
| 5,040,788 | A | 8/1991 | Randall | |
| 5,100,129 | A | 3/1992 | Porter et al. | |
| 5,135,445 | A | 8/1992 | Christensen et al. | |
| 5,176,602 | A | 1/1993 | Roberts | |
| 5,209,482 | A | 5/1993 | Hopfer | |
| 5,221,240 | A | 6/1993 | Mann et al. | |
| 5,254,065 | A | 10/1993 | Pollock | |
| 5,277,683 | A | 1/1994 | Wilkins | |
| 5,352,174 | A | 10/1994 | Mason et al. | |
| 5,415,608 | A | 5/1995 | Bode et al. | |
| 5,468,205 | A | 11/1995 | McFall et al. | |
| 5,498,223 | A | 3/1996 | Iams et al. | |
| 5,501,656 | A | 3/1996 | Homma et al. | |
| 5,505,677 | A | 4/1996 | Hinds | |
| 5,514,059 | A | 5/1996 | Romney | |
| 5,522,783 | A | 6/1996 | Gordon | |
| D372,507 | S * | 8/1996 | Chin | D21/687 |
| 5,549,532 | A | 8/1996 | Kropp | |
| 5,556,369 | A | 9/1996 | Roberts | |
| 5,571,064 | A | 11/1996 | Holm | |
| 5,597,376 | A | 1/1997 | Bode et al. | |
| 5,601,518 | A | 2/1997 | Weintraub | |
| 5,624,360 | A | 4/1997 | Wilkins | |
| 5,626,546 | A | 5/1997 | Little | |
| 5,688,210 | A | 11/1997 | Chou | |
| 5,766,118 | A | 6/1998 | Conner | |
| 5,807,214 | A | 9/1998 | Riazi | |
| 5,813,956 | A | 9/1998 | Iams et al. | |
| 5,820,529 | A | 10/1998 | Weintraub | |
| 5,871,424 | A | 2/1999 | Conner | |
| 5,910,073 | A | 6/1999 | Conner | |
| 5,924,966 | A | 7/1999 | Havlovic | |
| D414,228 | S | 9/1999 | Zwonitzer | |
| 5,957,819 | A | 9/1999 | Cortesi | |
| 6,015,371 | A | 1/2000 | Davitt | |
| 6,036,625 | A | 3/2000 | Woodruff | |
| 6,059,698 | A | 5/2000 | Mazor | |
| D427,257 | S | 6/2000 | Ray | |
| 6,102,836 | A | 8/2000 | Person | |
| 6,110,075 | A | 8/2000 | Woodruff | |
| 6,183,403 | B1 | 2/2001 | Dunn | |
| 6,267,711 | B1 | 7/2001 | Hinds | |
| 6,319,179 | B1 | 11/2001 | Hinds | |
| 6,322,483 | B1 | 11/2001 | Rotella | |
| 6,494,817 | B2 | 12/2002 | Lake | |
| 6,540,651 | B1 | 4/2003 | Aberton | |
| 6,908,418 | B2 | 6/2005 | Saure | |
| 6,941,620 | B1 | 9/2005 | Hinds | |
| 6,994,683 | B1 | 2/2006 | Starr | |
| 7,048,638 | B2 | 5/2006 | Novotny | |
| 7,322,909 | B1 | 1/2008 | Loccarini et al. | |
| 7,624,956 | B2 * | 12/2009 | Steigert et al. | 248/201 |
| 7,976,445 | B2 * | 7/2011 | Lalaoua | 482/129 |
| D650,451 | S * | 12/2011 | Olson et al. | D21/673 |
| 8,070,657 | B2 | 12/2011 | Loach | |
| D659,775 | S * | 5/2012 | Olson et al. | D21/673 |
| 2003/0158024 | A1 | 8/2003 | Saure | |
| 2003/0186792 | A1 | 10/2003 | Keeler | |
| 2004/0021046 | A1 * | 2/2004 | Hutchison | 248/300 |
| 2004/0025993 | A1 * | 2/2004 | Russell | 150/154 |
| 2004/0087420 | A1 | 5/2004 | Montesquieux | |
| 2004/0138032 | A1 | 7/2004 | Van Straaten et al. | |
| 2006/0019806 | A1 | 1/2006 | Mikulski | |
| 2006/0189460 | A1 | 8/2006 | Katterjohn | |
| 2007/0018465 | A1 | 1/2007 | Vassilakos et al. | |
| 2010/0173759 | A1 | 7/2010 | Lalaoua | |

OTHER PUBLICATIONS

Body by Jake website—Tower 200, (www.officialtower200.com) published, on information and belief, at least as early as Jun. 22, 2009, 35 pages.

Body by Jake—Tower 200 Promotional Spot video—60 seconds on DVD entitled "Body by Jake Tower 200 Try Risk Free $14.95", published, on information and belief, at least as early as Sep. 7, 2009.

Body by Jake—Tower 200 Promotional Spot video—120 seconds on DVD entitled "Body by Jake Tower 200 Try Risk Free $14.95", published, on information and belief, at least as early as Jun. 22, 2009.

"11 Minutes No Excuses—The Mother of All Workouts" DVD video and DVD case, published, on information and belief, at least as early as Jun. 22, 2009.

Photocopies of "Tower 200—11 Minutes No Excuses" exercise poster, which was published, on information and belief, at least as early as Jun. 22, 2009, 4 photograph pages.

Photocopies of individual portions of exercise poster, "Tower 200—11 Minutes No Excuses" published, on information and belief, at least as early as Jun. 22, 2009, 32 pages.

Advertising page "Get Bigger, Harder, Stronger . . . " published, on information and belief, at least as early as Jul. 2009, 1 page.

Photographs of Body by Jake Tower 200 product, which was available, on information and belief, at least as early as Oct. 2010, 8 pages of photographs (32 total photographs).

"Caution" instructions page, Body by Jake Assembly Instructions, available, on information and belief, at least as early as Oct. 2010, 1 page.

"Ultimate Muscle Explosion" Get-Started Guide, copyright 2009 (16 pages).

Complaint for Copyright Infringement, Federal Unfair Competition; California Unfair Competition and Trade Dress Infringement, filed Sep. 10, 2010, 29 pages.

Defendant Icon Health & Fitness, Inc.'s Memorandum in Support of Its Motion to Dismiss Plaintiff Body by Jake Global, LLC's Complaint, filed Oct. 25, 2010, 12 pages.

Declaration of Cara J. Baldwin in Support of Defendant's Motion to Dismiss Plaintiff Body by Jake Global, LLC's Complaint, filed Oct. 25, 2010, 7 pages.

Notice of Defendant Icon Health & Fitness, Inc.'s Motion to Dismiss Plaintiff Body by Jake Global, LLC's Complaint, filed Oct. 25, 2010, 3 pages.

Information about Related Patents and Patent Applications, see the section below having the same title.

* cited by examiner

DOOR MOUNTED EXERCISE DEVICES AND SYSTEMS

CROSS-REFERENCE TO RELATED APPLICATION

This application is a continuation-in-part of, and claims the benefit of and priority to, U.S. patent application Ser. No. 29/354,089, filed on Jan. 29, 2010, now U.S. Pat. No. D650, 451, issued Dec. 13, 2011 and entitled "Cable and Pulley Device for Exercise," which application is expressly incorporated herein by this reference, in its entirety.

TECHNICAL FIELD

This invention relates generally to exercise devices, assemblies, and systems, and more particularly to devices and assemblies for mounting an exercise system to a door.

BACKGROUND

Over the last four decades, the prevalence of obesity and weight-related ailments has increased dramatically. Indeed, under some estimates, more than sixty percent of all adults in the United States may be considered overweight or obese—and this percentage continues to climb. When a person is overweight, that person has more body fat than is optimum for a person's health. The accumulation of too much stored fat can not only change the appearance of a person's body, but can also impair movement and flexibility of the body, increase the strain on joints and bones, and reduce the effectiveness of the body's immune system.

Fortunately, public awareness of the causes and effects of being overweight has increased, and many people are not only learning about how the body uses fat, but are also making dramatic lifestyle changes. As part of that public awareness, people are becoming clued into the importance of proper nutrition and exercise. More recently, it has been recognized that it is important that an exercise program not only include cardiovascular training, but also strength training. Cardiovascular training can be highly effective in burning fat; however, by also including strength training in an exercise program, a body can more efficiently burn fat. For instance, strength training builds muscle, and extra muscle burns more energy, even when the body is at rest. Accordingly, by increasing the amount of muscle a body has, the same exercise program can result in more fat being burned.

While almost anyone can implement an exercise program into their life, it is difficult for many people to access sophisticated equipment and expansive facilities. For example, the cost to join a health club or gym is cost prohibitive to a large segment of the general public. Still others may have demands on their time that make it difficult or impossible to regularly travel to and from such facilities. The inability to consistently access the facilities of a gym or health club can be particularly difficult for a person who wants to implement strength training. A strength training system that provides a variety of different exercise options is large and expensive. Alternatively, smaller devices may also be available but dedicated to strength training a particular aspect of the body. Accordingly, there is an increased demand for exercise equipment that can not only be easily used and stored at home or the office, but which also is affordable, effective, and versatile.

One proposed solution for making strength training exercise equipment convenient and storable is described in U.S. Pat. No. 5,468,205 to McFall et al. ("McFall"). McFall discloses an exercise apparatus that purports to offer an apparatus that is "easily mounted or dismounted from any door or other vertically oriented and fixed-in-place partition and is small enough to fold and store in a small carrying case." In particular, the apparatus includes a pair of pulley support units mounted on a door by straps which vertically encircle the door. The pulley support units are interconnected by bands that run vertical paths between the support units.

In addition, other exercise devices and/or door brackets include those in U.S. Pat. Nos. 3,118,441, 4,428,578, 4,606, 541, 4,685,670, 4,830,365, 4,861,020, 5,221,240, 5,254,065, 5,277,683, 5,571,064, 5,601,518, 5,766,118, 5,807,214, 5,820,529, 5,871,424, 5,910,073, 5,924,966, 6,015,371, 6,036,625, 6,059,698, 6,319,179, 6,322,483, 6,494,817, 7,322,909, U.S. Patent Publication No. 20030186792, and U.S. Patent Publication No. 20040087420.

SUMMARY OF THE INVENTION

In one aspect of the disclosure, a door bracket includes a door mount and an exercise device mount attached to the door mount. The door mount is sized to couple to a door and the exercise mount is configured to connect to an exercise device.

In another aspect that may be combined with any of the aspects herein, the door mount defines a channel extending along a first lateral axis.

In another aspect that may be combined with any of the aspects herein, a channel of a door mount is defined by at least three structures, including a bottom structure and two side structures extending about perpendicular to the bottom structure.

In another aspect that may be combined with any of the aspects herein, the exercise device mount is attached to a side structure of a door mount.

In another aspect that may be combined with any of the aspects herein, the exercise device mount is oriented longitudinally along a second lateral axis that is non-parallel and non-perpendicular relative to a first lateral axis.

In another aspect that may be combined with any of the aspects herein, a door channel is further defined by a stop structure extending about perpendicular to the bottom structure.

In another aspect that may be combined with any of the aspects herein, a stop structure is about perpendicular to first and second side structures.

In another aspect that may be combined with any of the aspects herein, a door mount includes one or more plates at least partially defining bottom and side structures.

In another aspect that may be combined with any of the aspects herein, a side structure has opposing transverse edges of differing lengths.

In another aspect that may be combined with any of the aspects herein, opposing transverse edges of a side structure are about parallel.

In another aspect that may be combined with any of the aspects herein, a side structure is generally trapezoidal or generally triangular in shape.

In another aspect that may be combined with any of the aspects herein, a side structure includes a plate having a longitudinal edge offset at an acute angle relative to a first lateral axis.

In another aspect that may be combined with any of the aspects herein, at least a portion of an exercise device mount defines an edge that is non-parallel and non-perpendicular relative to a first lateral axis.

In another aspect that may be combined with any of the aspects herein, an exercise device mount defines a second channel.

In another aspect that may be combined with any of the aspects herein, a second channel is adjacent a door channel and/or aligned with one or more receptors in an exercise device mount.

In another aspect that may be combined with any of the aspects herein, one or more receptors are aligned along an axis that is at an acute angle relative to a first lateral axis.

In another aspect that may be combined with any of the aspects herein, an exercise device mount includes first and second mounting structures, the second device mount structure being connected to the first device mount structure at an axis that is non-parallel and non-perpendicular relative to a first lateral axis In another aspect that may be combined with any of the aspects herein, a door mount and exercise device mount are at least partially integrally formed from a single plate.

In another aspect that may be combined with any of the aspects herein, a bottom structure has a size generally corresponding to a door thickness and extends longitudinally along a first bisection axis.

In another aspect that may be combined with any of the aspects herein, a side structure includes an exercise device mount extending at least partially along a second bisection axis that is offset at an acute angle relative to a first bisection axis.

In another aspect that may be combined with any of the aspects herein, a side structure includes a bend separating a door contact portion from an exercise device mount.

In another aspect that may be combined with any of the aspects herein, an exercise system includes two door brackets attached to a set of one or more tension members.

In another aspect that may be combined with any of the aspects herein, door brackets of an exercise system cooperate to extend a set of one or more tension members diagonally across a front surface of a door when mounted to a door.

In another aspect that may be combined with any of the aspects herein, a door bracket is arranged to mount at a corner of a door.

In another aspect that may be combined with any of the aspects herein, door brackets of an exercise system include device mounts arranged to direct a set of one or more tension members at an acute angle relative to a top edge surface of a door.

In another aspect that may be combined with any of the aspects herein, an exercise system includes a second set of two door brackets and a second set of one or more tension members.

In another aspect that may be combined with any of the aspects herein, a second set of one or more tension members, when mounted to a door, extend diagonally across a front surface of the door and in a direction forming an "X" with a first set of one or more tension members.

In another aspect that may be combined with any of the aspects herein, one or more pulleys are attached to a door bracket.

In another aspect that may be combined with any of the aspects herein, multiple pulleys are attached to a door bracket and, when the door bracket is mounted on the door, the pulleys are at different distances from a top edge surface of the door.

In another aspect that may be combined with any of the aspects herein, one or more pulleys are pivotally attached to the door bracket while remaining fixed at a particular angle relative to a door channel.

In another aspect that may be combined with any of the aspects herein, one or more pulleys are attached to a door bracket using a coupling that is at least partially housed within a connector channel.

In another aspect that may be combined with any of the aspects herein, one or more an exercise device mount is adapted to direct one or more tension members at an angle ranging between about ten and about thirty-five degrees relative to an axis of a door channel.

In another aspect that may be combined with any of the aspects herein, when a door bracket is mounted to a door, an exercise device mount is inclined at a first acute angle relative to an axis extending along a side edge surface of the door and at a second acute angle relative to an axis extending along a top edge surface of the door.

In another aspect that may be combined with any of the aspects herein, an exercise device mount includes an integral structure with a complex bend forming multiple structures at angled orientations relative to a bottom structure of the door bracket.

In another aspect that may be combined with any of the aspects herein, a door bracket includes an end structure adapted to counteract a lateral force placed on a door bracket.

In another aspect that may be combined with any of the aspects herein, a side structure of a door bracket includes first and second lateral axes and a lateral bisection axis, each of which are at different angles.

In another aspect that may be combined with any of the aspects herein, one or more tension members are coupled to at least two door brackets and, when the door brackets are mounted to a door, the one or more tension members exert a force on the door brackets, the force having a horizontal component.

In another aspect that may be combined with any of the aspects herein, internal forces alone cause one or more tension members to exert a force having a horizontal component.

In another aspect that may be combined with any of the aspects herein, a force having a horizontal component is exerted and stabilizes positions of at least one door bracket.

Further embodiments and uses of the exercise system and door mount brackets and assemblies of FIGS. 1-4D are shown in U.S. patent application Ser. No. 29/354,089.

DETAILED DESCRIPTION

A portable, easily accessible, and/or versatile strength training exercise device may be desirable for use by any person, including those seeking to develop lean muscle mass, sculpt their body, burn fat, avoid obesity, or for any combination of the foregoing. The devices, assemblies, systems, and methods described herein generally relate to an exercise device that may be mounted to a planar member such as a door. Consequently, the devices, assemblies, systems, and methods described herein may be used in any environment in which a door is available to a person desiring to exercise.

Figure 1:
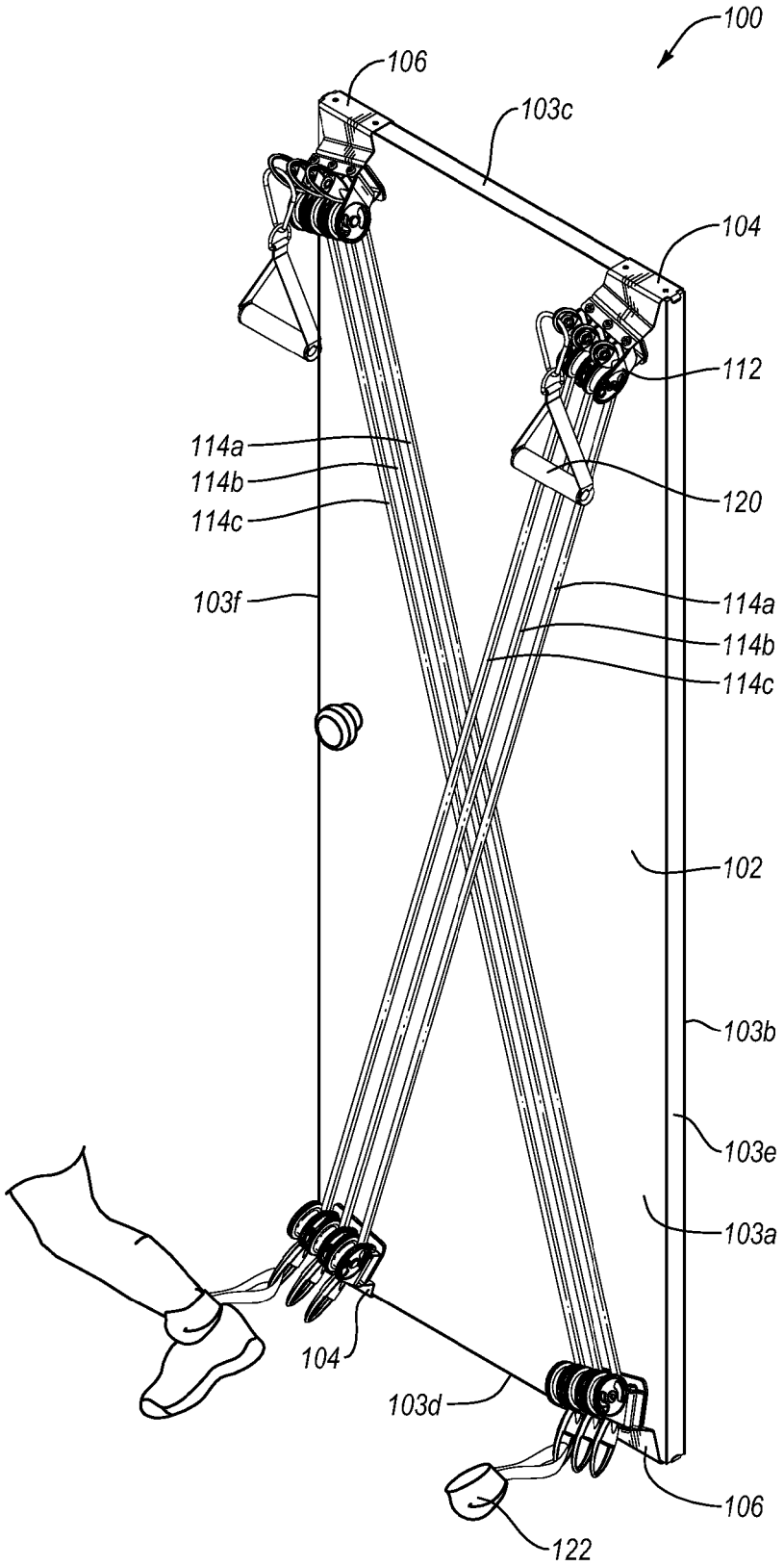
FIG. 1 is a perspective view of a door-mounted exercise system according to an example embodiment of the present disclosure.

FIG. 1 illustrates an exercise system 100 according to an example embodiment. The exercise system 100 is, in this embodiment, mounted to a door 102. The door 102 is representative of number of types or sizes of doors or other planar members to which one or more of the door mount assemblies 104, 106 may be attached. For instance, the door 102 may be a door in a home, office, or other location. The door 102 may be an internal door (i.e., within a doorway connecting two internal rooms or locations), an external door (i.e., within a doorway connecting an internal room or location to an outside or other external location), a closet door, a suspended wall, or the like. Accordingly, while the exercise system 100 may be referred to herein as a door mountable exercise system, the exercise system 100 is not necessarily limited to use on doors.

For ease of reference, the system 100 will be described as mounted to, or engaging, various difference surfaces of the door 102. In this embodiment, the door 102 includes six door surfaces 103*a-f*. Reference to the front surface of a door 102 refers generally to the illustrated vertical surface 103*a* to which both of the door mount assemblies 104, 106 attach. The front surface of the door 102, as used herein, is thus intended to refer to the surface across which the tension members 114*a-c* extend, and the vertical surface 103*a* which faces the user when the door mountable exercise system 100 is in use. The rear surface of a door 102 refers generally to the vertical surface 103*b* which is opposite the vertical surface 103*a* and is separated from the vertical surface 103*a* by the edge surfaces 103*c-f*.

The edge surfaces 103*c-f* can generally be described as vertical or horizontal edge surfaces, as depicted in the embodiment illustrated in FIG. 1. For instance, the vertical edge surfaces 103*c*, 103*d* may be referred to herein as left and right edge surfaces, respectively, or simply as side edge surfaces, although the particular oriented descriptors (e.g., vertical, left, right, etc.) may be altered based on the perspective from which the door 102 is viewed. Similarly, the horizontal edge surfaces 103*e*, 103*f* may be referred to herein as top and bottom edge surfaces, or upper and lower edge surfaces, although the nomenclature including the oriented descriptors of horizontal, top, and bottom, are also in relation to the particular view of the door 102 in FIG. 1.

With continued reference to FIG. 1, the exercise system 100 includes multiple door mount assemblies 104, 106 and tension members 114*a-c* connecting various door mount assemblies 104, 106. In this particular embodiment, two first door mount assemblies 104 are coupled together by a set of three tension members 114*a-c*. The first door mount assemblies 104 attach to opposing corners of the door 102 and the tension members 114*a-c* extend diagonally across the front surface 103*a* of the door 102, and from the top right corner to the lower left corner. The second door mount assemblies 106 are similarly configured and are coupled together by an identical set of three tension members 114*a-c*, although any non-identical tension members may also be used. The second door mount assemblies 106 attach to opposing corners of the door 102 and the tension members 114*a-c* attached thereto extend diagonally across the front surface 103*a* of the door 102, from the top left corner to the lower right corner. As the tension members 114*a-c* coupled to each set of door mount assemblies 104, 106 extend diagonally in opposing directions, they may cross. For instance, in FIG. 1, a set of tension members 114*a-c* extends diagonally and crosses an opposing set of tension members 114*a-c* at a point aligned approximately in the middle of the door 102.

The first door mount assemblies 104 are connectable to the front, right corner of the door 102 and to the bottom, left corner of the door 102. As will be appreciated in view of the disclosure herein, the first door mount assemblies 104 contact or otherwise engage multiple door surfaces so as to secure the first door mount assemblies 104 to the door 102. For instance, the first door mount assembly 104 at the upper right corner of the door 102 contacts the front surface 103*a*, rear surface 103*b*, top edge surface 103*c*, and right edge surface 103*e* of the door 102. In a similar manner, the first door mount assembly 104 at the bottom, left corner of the door 102 contacts the front surface 103*a*, rear surface 103*b*, bottom edge surface 103*d*, and left edge surface 103*f* of the door 102. The second door mount assemblies 106 are similarly configured and collectively also contact each of the surfaces 103*a-f* in similar, but oppositely oriented, manner.

Any number of suitable materials or mechanisms may be used as the tension members 114*a-c* that attach to, and extend between, mated pairs of the first and second door mount assemblies 104, 106. For instance, in one embodiment, the tension members 114*a-c* are resistance members. Such resistance members are attachable to the door mount assemblies 104, 106 and to one or more handles 120 and/or ankle bands 122. For instance, the tension members 114*a-c* may be made of a resilient material. As a user pulls on a handle 120, for instance, the user may stretch the resilient material. The amount of force required to stretch the resilient material a particular distance may be based on the elastic properties of the material. The resistance provided by the resilient materials may also vary from one tension member 114*a-c* to the next. By way of illustration, the tension member 114*a* may have one set of elastic properties, while the tension member 114*b* and/or tension member 114*c* has another set of elastic properties. Thus, a user can select the resistance desired for an exercise, or can combine resistances for even greater resistance options. For instance, if the three tension members 114*a-c* each have different elastic properties, up to seven different resistances may be obtained based on the combination of which one, two, or three tension members 114*a-c* are used at any given time. Of course, more or fewer tension members 114*a-c* may also be coupled to the door mount assemblies 104, 106.

While the tension members 114*a-c* may include resilient materials, other types of tension and/or resistance members may be used. For instance, in other embodiments, the tension members 114*a-c* include cables. Where the tension members 114*a-c* include cables, the door mount assemblies 104, 106 optionally include pulleys 112 mounted thereto. The pulleys 112 may allow the cables to extend therearound and move as a force is applied by a user. For instance, if a user pulls on a handle 120 and/or ankle band 122, the cable may move and cause the pulley 112 to rotate. A cable may be attached to a weight or resistance member, or itself may be a resistance member.

While FIG. 1 illustrates an exercise system 100 that is door mountable diagonally at four corners of a front surface 103*a* of a door 102, it should be appreciated that this is merely exemplary. In other embodiments, an exercise system may include a single set of first door mount assemblies 104 or second door mount assemblies 106, such that the exercise system couples to only two corners of the front surface 103*a* of the door 102. Further, while the exercise system 100 is described as having a set of tension members 114*a-c* coupling together two identical door mount assemblies 104, 106, this is merely exemplary. In other embodiments, a set of one or more tension members 114*a-c* may couple door mounts that are not identical.

Figure 2:
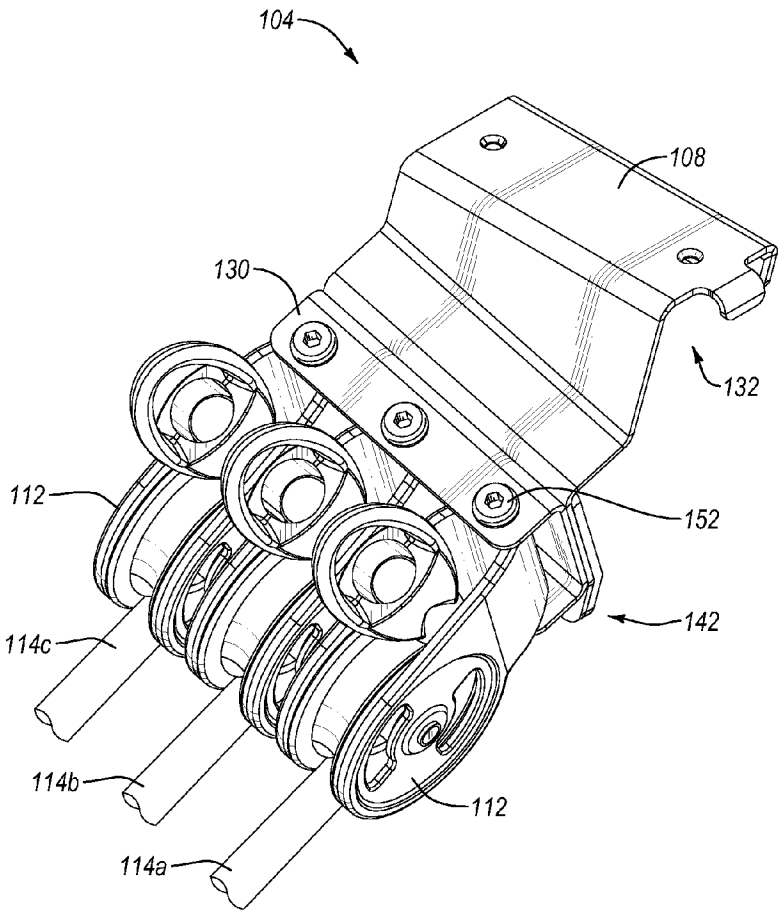
FIG. 2 is a perspective view of a first door mount bracket assembly according to an example embodiment of the present disclosure, and is shown in the door-mounted exercise system of FIG. 1.

The exercise system described in connection with FIG. 1 incorporates two first door mount assemblies 104, and two second door mount assemblies 106, which are described in greater detail in connection with FIGS. 2-3D. For example, FIG. 2 illustrates a single first door mount assembly 104, and includes a bracket 108 attached to three pulleys 112. The pulleys 112 are mounted to the bracket 108 using an exercise device mount 142, and each of the pulleys 112 is connected to a respective tension member 114*a-c*. The tension members 114*a-c* may, for instance, extend to a corresponding door mount assembly (see FIG. 1), and may be arranged to extend vertically, horizontally, or diagonally across a door.

The pulleys 112 shown in FIG. 2 are each illustrated as being identical, and being horizontally and vertically offset along the bracket 108. The pulleys 112 are mounted in the illustrated embodiment using a pulley coupling 130. The pulley coupling 130 takes, in this embodiment, the form of a C-shaped channel bracket, and is mounted to the bracket 108. The pulley coupling 130 may take other forms, and can be welded, soldered, bolted, riveted, integrally formed with, or otherwise connected to the bracket 108. To secure the pulley 112 to the pulley coupling 130, a connector 152 is used. For instance, the connector 152 may include a bolt, pin, or other connector that extends at least partially through the pulley coupling 130 and the pulley 112. The pulley 112 is optionally rotatable over a range of different angular orientations relative to the connector 152. For instance, the pulley 112 may rotate relative to the connector 152 and between angular positions offset by up to about one-hundred eighty degrees. In other embodiments, the pulley 112 is rotatable relative to the connector 152 more or less than one-hundred eighty degrees. For instance, in one embodiment, the pulley 112 may rotate and follow an arc defined by between about seventy-five and about one-hundred twenty degrees of rotation. In still other embodiments, less than seventy-five degrees rotation is permitted. For instance, the pulley 112 may be fixed at a particular angular orientation relative to the pulley connector 152. In still other embodiments, the pulleys 112 may rotate, but an axis on which the pulleys are aligned remains fixed at an angle relative to the top edge surface of the door to which the bracket 108 is mounted.

In FIG. 2, the bracket 108 of the first door mount assembly 104 is configured to couple the door mount assembly 104 to a corner of a door. Thus, in some embodiments, the bracket 108 is a door bracket. More particularly, the bracket 108 includes or defines a door mount 132 that enables the bracket 108 to be securely coupled to a door. As described in greater detail herein, the door mount 132 includes, in some embodiments, multiple plates or surfaces, and such plates or surfaces may be integrally or separately formed. The multiple plates or surfaces can couple the bracket 108 to a door corner in a manner that contacts three or four surfaces of the door. Particularly in an embodiment in which the bracket 108 contacts four door surfaces, the bracket 108 acts to counteract lateral forces that would tend to shift the position of the bracket 108 along a top or bottom edge surface of a door. Thus, diagonal orientation and tension capability of the door mount assemblies 104, 106) is particularly advantageous.

For instance, if a tension member 114*a-c* is placed under tension, the bracket 108 may experience a corresponding tensile force that is directed along a path between two coupled brackets 108. As will be appreciated upon a review of the exercise system 100 illustrated in FIG. 1, such a tensile force may act in a diagonal direction relative to a door or other surface, exerting a force that attempts to pull the bracket 108 towards the center of the door. When the diagonally directed force is applied to the bracket 108, the tensile force may thus have both a horizontal and a vertical component acting parallel to a front surface of the door. A surface of the door mount 132 of the bracket 108 may contact and press against a top or bottom edge surface of a door to counteract the vertical component of the tensile force. Similarly, another surface may press against a side edge surface of the door to counteract the horizontal or lateral component of the tensile force. Accordingly, the door mount 132 may act to secure the bracket 108 in place on a door even when lateral forces are applied to the bracket 108.

Figure 3A:
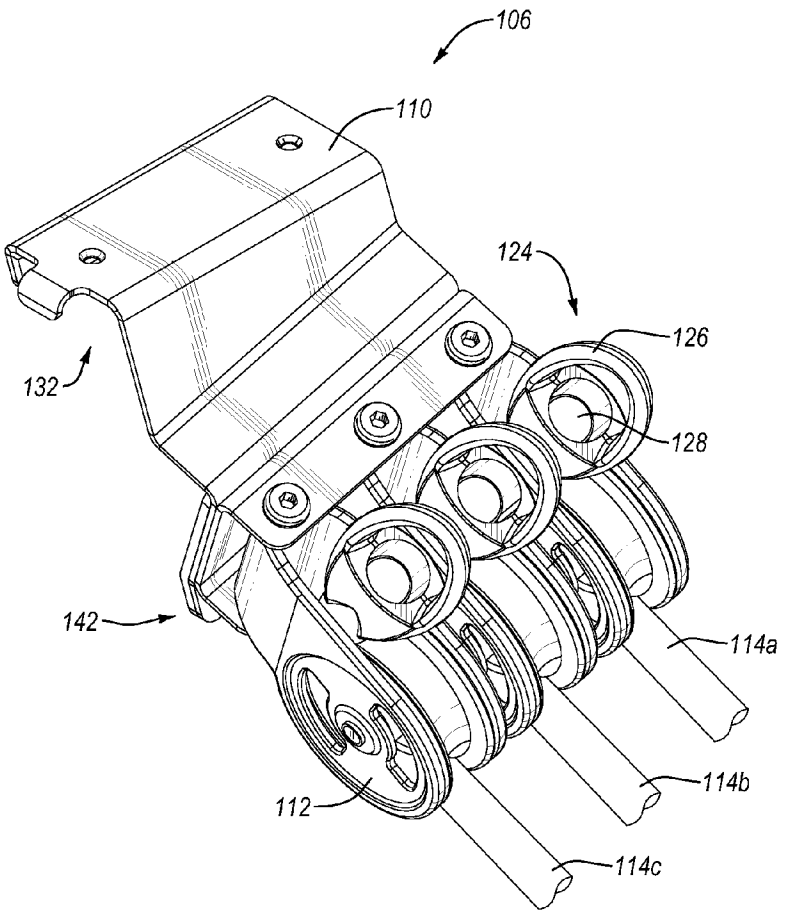
FIG. 3A is a perspective view of a second door mount bracket assembly that is also shown in FIG. 1 and that is at least a substantial mirror-image of the door mount bracket assembly of FIG. 2.

With reference now to FIG. 3A a door mount assembly 106 is illustrated. It will be appreciated in view of the disclosure herein that door mount assembly 106 is similar in many regards to the door mount assembly 104 illustrated in FIG. 2, being the minor image thereof, and thus operates in a similar manner, and with similar or identical components. Door mount assembly 106 includes a bracket 110. The bracket 110 in FIG. 3A is also sized and otherwise configured to mount to a door. Thus, the bracket 110 in FIG. 3A may also be a door bracket, and can include a door mount 132 adapted to securely couple the bracket 110 to a door. The bracket 110 in FIG. 3A is a minor image to the bracket 108 of FIG. 2.

As with the door mount assembly 104 of FIG. 2, the bracket 110 includes an exercise device mount 142 that couples a set of pulleys 112 to the bracket 110. Each pulley 112 is, in turn, attached to a corresponding one or more tension members 114*a-c*. The tension members 114*a-c* may be wrapped at least partially around a rotating ring within the pulleys 112, and placed in a first state. In the first state, the tension members 114*a-c* may not have an external tensile force applied. For instance, any tensile force in the tension members 114*a-c* may result from the position of the door mount assembly 104 relative to another door mount assembly 106 or another component coupled to the tension members 114*a-c* when each is mounted to a door. When a user applies a tensile force, an external force may be applied to transition the tension members 114*a-c* to a second state. In transitioning to the second state, the tension members 114*a-c* can stretch or otherwise move and optionally cause the pulley 112 to rotate. When the force is released, the tension member 114*a-c* may move back to the first state. For instance, the tension members 114*a-c* may be made of a resilient material. At the second state, the tension members 114*a-c* may undergo elastic deformation such that upon release of the tension members 114*a-c*, the tension members 114*a-c* naturally contract back to their first state.

When the tension members 114*a-c* are in the first state, one or more components may act on the tension members 114*a-c* to maintain the tension members 114*a-c* attached to the pulleys 112. In FIG. 3A, for instance, each tension member 114*a-c* is connected to a coupling 124. The coupling 124 in FIG. 3A includes a fastener 128. In particular, the fastener 128 includes, in this embodiment, a body defining an opening. The opening is sized to receive and retain an end of a corresponding one of the tension members 114*a-c*. The body of the fastener 128 is larger than at least a portion of the pulley 112. As a result, the body of the fastener 128 engages against the pulley 112 and substantially prevents the coupling 124 from being pulled around the rotating ring of the pulley 112. The coupling 124 in FIG. 3A also includes a loop 126 attached to the fastener 128. The loop 126 also facilitates use of the tension members 114*a-c*. For instance, a handling component (e.g., handle 120 in FIG. 1) may be selectively or permanently attached to the loop 126. A user may then pull or otherwise manipulate the handling component to apply a force to the tension members 114*a-c*. The handling component is optionally selectively coupleable to any one of the couplings 124 illustrated in FIG. 3A. In some embodiments, a handling component may be attached to more than one coupling 124. For instance, a handling component may be selectively attached to up to three couplings 124 at any single time. Where more couplings 124 and tension members 114*a-c* are used, the handling component could be attached to more than three couplings 124.

Figure 3B:
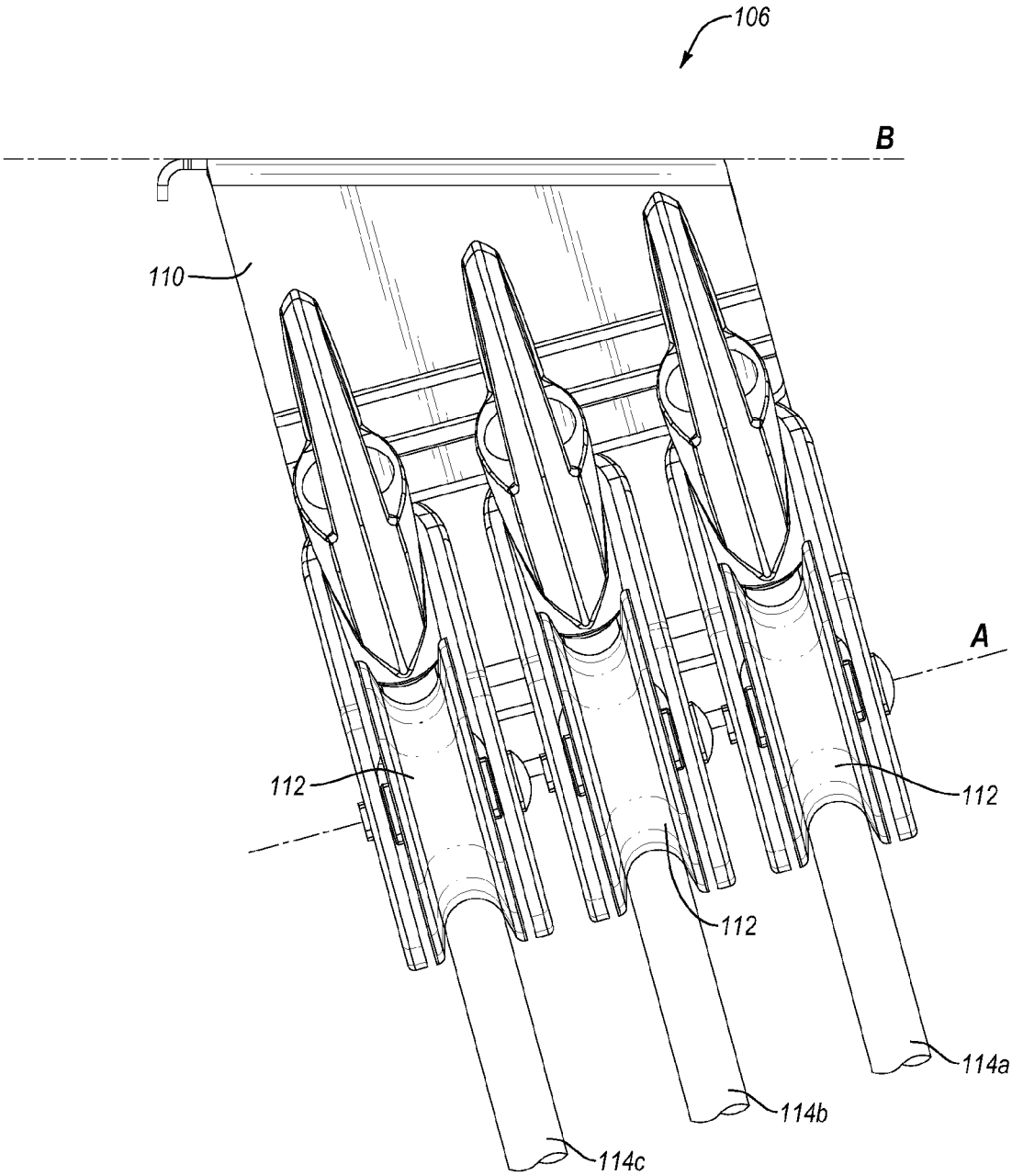
FIG. 3B illustrates a front view of the example embodiment of the door mount bracket assembly illustrated in FIG. 3A.
Figure 3C:
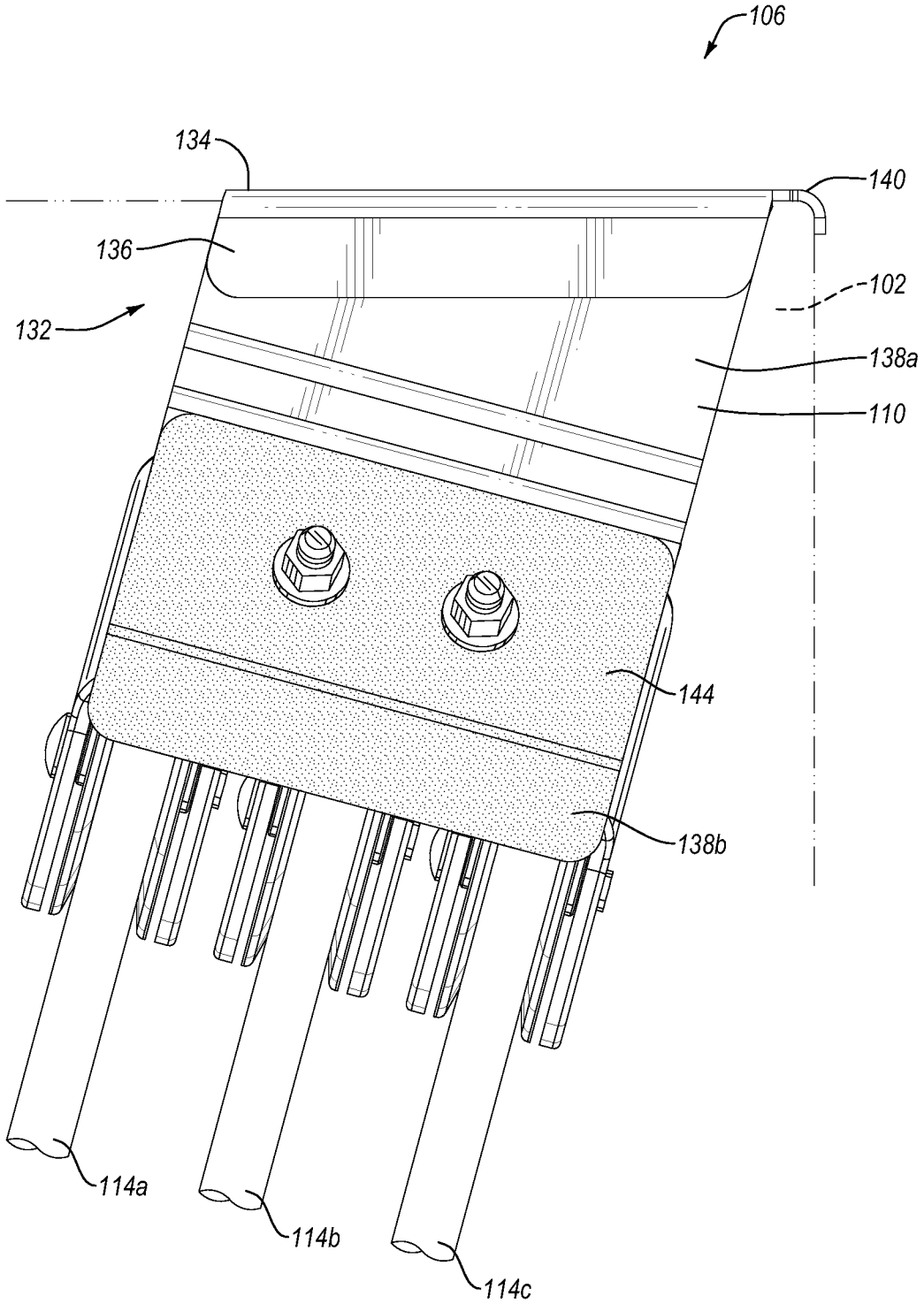
FIG. 3C illustrates a rear view of the example embodiment of the door mount bracket assembly illustrated in FIG. 3A.

FIGS. 3B and 3C illustrate frontal and rear views, respectively, of the exemplary door mount assembly 106 of FIG. 3A. Hereafter, various exemplary aspects of devices, assemblies, systems, and methods relating to mounting an exercise device to a door are described with reference to the door mount assembly 106 and/or the bracket 110 of FIGS. 3A-3D. To simplify the discussion herein, such aspects are described with particular reference to the door mount assembly 106 and/or the bracket 110, although it should be appreciated that the discussion is equally applicable to the door mount assembly 104 and/or the bracket 108 of FIG. 2.

As noted previously, one aspect of the door mount assembly 106 and the bracket 110 of the present disclosure is that they may be included within a diagonally oriented exercise system such that lateral forces may be applied to the door mount assembly 106 and the bracket 110, and without causing the bracket 110 to shift lateral positions across a horizontal top or bottom edge surface. With reference to the application of lateral forces to the door mount assembly 106 in FIG. 3B, the bracket 110 causes the tension members 114*a-c* to be diagonally oriented relative to a door to which the door mount assembly 106 is coupled. Accordingly, a diagonal force is intended to be applied to the door mount assembly 106, and can include a vertical and lateral component. For instance, the pulleys 112 in FIG. 3B are aligned along, an axis A. As described in greater detail herein, the axis A that extends through the pulleys 112 may be at an angle that corresponds to a diagonal orientation of the tension members 114*a-c* across a front surface of a door. For instance, in one embodiment, the axis A is at an angle relative to a top and/or bottom edge surface of a door. The top and/or bottom edge of the door may extend generally parallel to an engagement surface of the bracket 110. An engagement surface may, for instance, be oriented along the axis B. In one embodiment, the angle between axis A and axis B is between about ten and about forty degrees, although such angle may vary and may exceed forty degrees or be less than ten degrees. In another embodiment, axis A is at an angle of between about twelve and about twenty-five degrees relative to axis B. In some embodiments, the angle generally corresponds to a size of a door such that the tension members 114*a-c* coupled to the pulleys 112 extend diagonally at an angle that is also between about ten to about forty degrees, between about twelve and about twenty-five degrees, or at some other angle generally related to a diagonal across the door or a diagonal defined by the bracket 110. For instance, the tension members 114*a-c* may be directed by the exercise device mount 142 at any angle that is non-parallel and/or non-perpendicular relative to a left and/or right edge surface of a door to which the door mount assembly 104 is attached.

The relationship between the door 102 and the tension members 114*a-c* is best illustrated in FIG. 3C. In FIG. 3C, a door 102 is illustrated in dashed lines to show an approximate alignment of the door 102 relative to the bracket 110. The door 102 is coupled to the bracket 110 using a door mount 132 of the bracket 110. The door mount 132 in FIG. 3D uses multiple structures to engage the door 102. More particularly, engagement structures 134, 136, 138 and 140 engage four surfaces of the door 102. In the illustrated embodiment, for instance, a first engagement structure 134 engages a top or bottom edge surface of the door 102. A second engagement structure 136 engages a rear surface of the door 102 while an opposing third engagement structure 138 engages a front surface of the door 102. The third engagement structure 138 optionally includes multiple portions. For instance, FIG. 3C illustrates a third engagement structure 138 having first and second portions 138*a*, 138*b*. The second portion 138*b* is, in FIG. 3C, at least partially vertically offset from the first portion 138*a*, thereby spreading out the contact with the front surface of the door 102. A fourth engagement structure 140 engages a side edge surface of the door 102. The engagement structures 134, 136, 138, 140 may take any suitable form. In FIG. 3B, for instance, the engagement structures 134, 136, 138, 140 are formed from one or more plates having a generally constant thickness. In other embodiments, the engagement structures 134 136, 138, 140 can be formed from other suitable materials, and can include contact surfaces or points at which the engagement structures 134, 136, 138, 140 engage the door.

The bracket 110 of FIG. 3C may be formed from any number of materials. For instance, the bracket 110 may be made from steel, aluminum, or another metal, or alloy. The bracket 110 may additionally or alternatively be made from a wide variety of other types of materials. Accordingly, the bracket 110 can be produced from materials that include metals, alloys, composites, organic materials, polymers, other materials, or any combination of the foregoing. In general, the material(s) used to produce the bracket 110 will be sufficient to resist tensile forces applied to the bracket 110 without fracture. In some embodiments, the material will be rigid and hard. As such a material is placed on a door, some doors may be formed of softer materials. Accordingly, in the embodiment in FIG. 3C, one or more engagement structures of the bracket 110 are adapted to include a cushioning component 144. The cushioning component 144 may be formed of a material that is softer than the bracket 110 and/or is less likely to damage a door to which the bracket 110 is attached to the door. For instance, the cushioning component 144 may be formed of a foam or rubber material, although other materials may also be used.

In FIG. 3C, the cushioning component 144 is shown as being coupled to at least the second structure 138*b* of the third engagement surface. It should be appreciated that this is exemplary. In other embodiments, the cushioning component may additionally or alternatively be coupled to any or all of the engagement structures 134, 136, 138, 140 that are configured to contact or otherwise engage the door 102 or other planar member.

While the cushioning component 144 may be softer than the door 102 and/or the bracket 110, this need not be the case. For instance, in some embodiments, the cushioning component 144 additionally or alternatively provides a function other than, or in addition to, softening the interface between the door 102 and the bracket 110. By way of illustration, the bracket 110 forms a door channel having a transverse width that is at least as large as a thickness of the door 102 to which the bracket 110 is to be attached. Doors may, however, be available in a number of different widths. The cushioning component 144 may be placed on one or more structures of the bracket 110 to reduce the overall width of the door channel, thereby providing a mechanism for adjusting the size of the door channel. The cushioning component 144 may be removable or adjustable so that different sizes or thicknesses may be used. In some embodiments, however, such as where the cushioning component 144 is formed of a soft or resilient material, the cushioning component 144 may be configured to deform to adapt the size of the door channel to allow the bracket 110 to fit tightly around doors having any number of different door thicknesses.

Figure 3D:
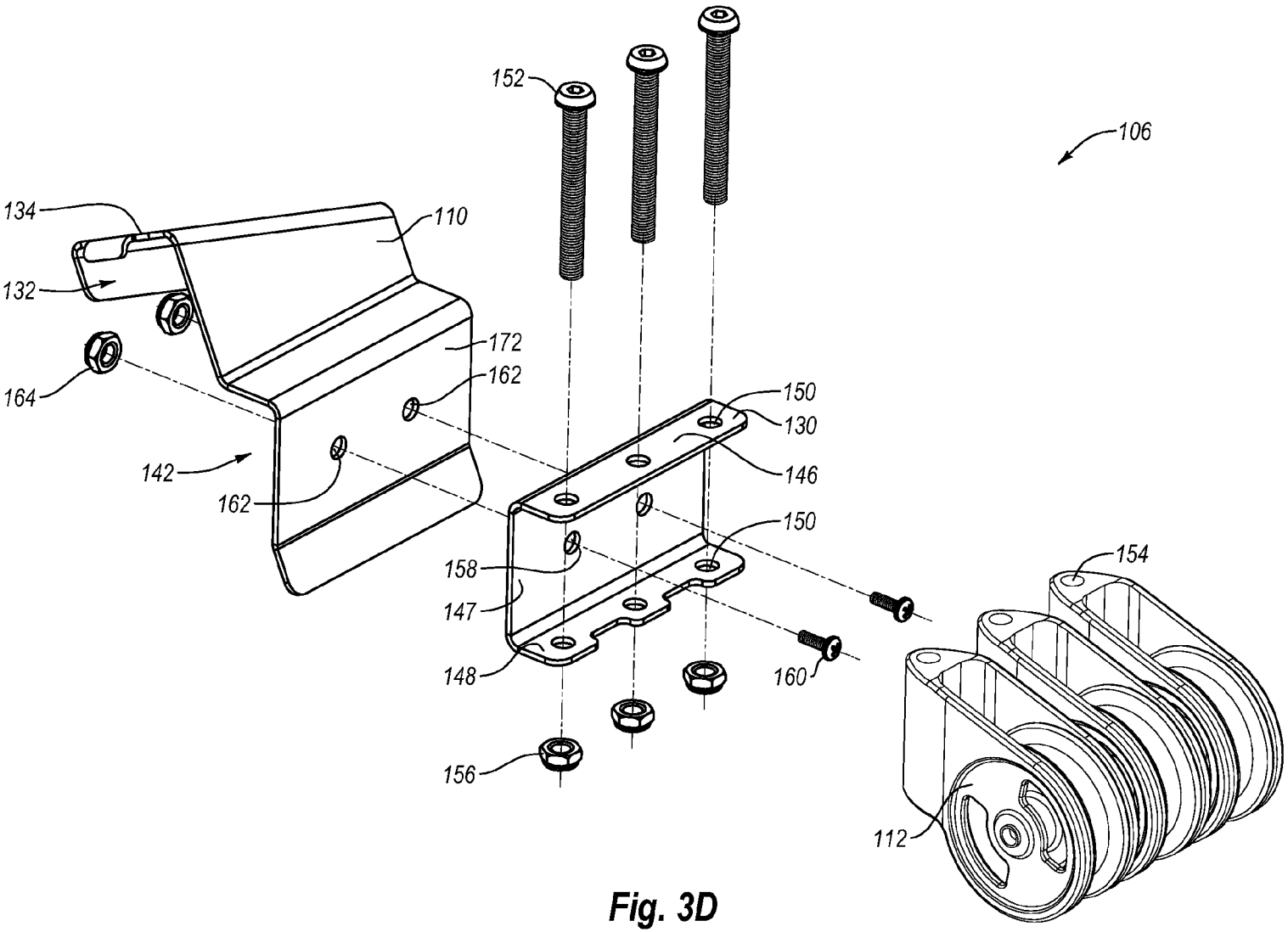
FIG. 3D illustrates an exploded view of the example embodiment of the door mount bracket assembly illustrated in FIG. 3A.

Referring to FIG. 3D, an exploded view illustrates the door mount assembly 106 of FIGS. 3A-3C. As shown, the door mount assembly 106 includes a bracket 110. The bracket 110 may include or define a door mount 132 and an exercise device mount 142. The door mount 132 is generally sized and shaped to securely couple the bracket 110 to a door, while the exercise device mount 142 is sized and arranged to couple the bracket 110 to a set of pulleys 112 and/or tension members 114*a-c* (see FIGS. 1-3C) in a manner that orients the tension members in a diagonal direction relative to a door. More particularly the exercise device mount 142 may be arranged in a manner such that when the bracket 110 is attached to a door, the tension members 114*a-c*, in a natural or first state, are directed diagonally across a front surface of the door, and such that a longitudinal axis along which the tension members 114*a-c* are oriented has both horizontal and vertical components.

All or a portion of the exercise device mount 142 may be included on the bracket 110. For instance, in FIG. 3D, the bracket 110 includes two receptors 162. The receptors 162 of FIG. 3D include holes defined within one or more structures of the bracket 110. The receptors 162 align with one or more corresponding mounting apertures 158 in a pulley coupling 130. For instance, the pulley coupling 130 includes a C-shaped channel bracket having upper and lower plates 146, 148, each coupled to an interposed plate structure 147. The mounting apertures 158 are formed within the plate structure 147, and aligned along a longitudinal axis of the plate structure 147.

The distance between two mounting apertures 158 in the medial plate 147 of the C-shaped channel bracket is about equal to the distance between the receptors 162 in bracket 110. A set of connectors 160, 164 is then used to couple the pulley coupling 130 to the bracket 110. In this embodiment, the connectors 160, 164 include a bolt and nut. The bolt passes through one of the mounting apertures in the pulley coupling 130 as well as through a corresponding receptor in the bracket 110. The nut is thereafter secured to the bolt and tightened, thereby securing the pulley coupling 130 to the bracket 110.

Although the connectors 160, 164 of FIG. 3D take the form of a bolt and nut, any suitable connector could be used to selectively or permanently attach the pulley coupling 130 to the bracket 110. For instance, the connectors 160, 164 may include a clamp, clip, quick-release mechanism, cotter pin, rivet, weld, or another suitable mechanism, or any combination of the foregoing. Moreover, such connectors 160, 164 may produce a connection that is permanent or that is selective or temporary. In still other embodiments, the pulley coupling 130 may be coupled to the bracket 110 by being integrally formed therewith.

As also shown in FIG. 3D, the receptors 162 and the mounting apertures 158 are generally aligned along, and centered within, the surfaces on which they are formed. This is merely exemplary. For instance, and as discussed in greater detail herein, the mount structure 172 on which the apertures are aligned is optionally angled relative to a first engagement structure 134 of the bracket 110. The first engagement structure 134 may, for instance, include a contact surface configured maintain a generally horizontal position when the bracket 110 is mounted on a door. In such a position, the mount structure 172 of FIG. 3D is generally inclined relative to a top edge of the front surface of the door and/or relative to the first engagement structure 134. Such an alignment may facilitate mounting of the pulleys 112 in a manner that angles coupled tension members diagonally across the front surface of the door.

One or more pulleys 112 are attached to the bracket 110. In FIG. 3D, for instance, a pulley 112 includes an opening 154 that can be aligned with exercise device mount openings 150 formed in the upper and lower plate structures 146, 148 of the pulley coupling 130. A first connector 152, such as a bolt, passes through the exercise device mount openings 150 and the pulley opening 154, and is secured therein by a second connector 156, such as a nut, although any type of connection may be used. In some embodiments, as discussed herein, the first connector 152 mounts the pulley 112 to the pulley coupling 130 in a manner that allows the pulley 112 to pivot at least partially around, and rotate relative to, the first connector 152, while also fixing the multiple pulleys 112 along a mounting axis that is inclined relative to the first engagement structure 134 of the bracket 110.

A more particular discussion of the bracket 110 used in connection with the door mount assembly 106 of FIGS. 3A-3D is provided in reference to FIGS. 4A-4D. It should be appreciated, however, that the bracket 110 is merely one exemplary bracket that may be used in a door mountable exercise system. For instance, additional brackets and components are contemplated that differ from the bracket 110 in various regards, but which also arrange tension members such that they are directed diagonally across a front door surface, even in the absence of user intervention.

Figure 4B:
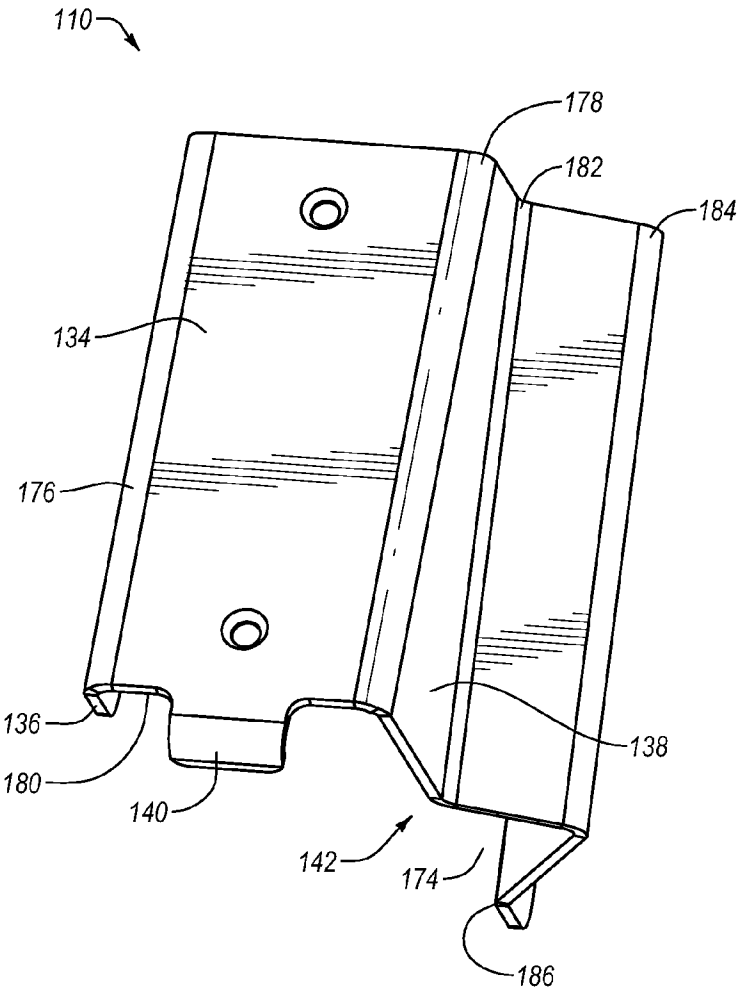
FIG. 4B illustrates a perspective view of the example embodiment of a door bracket illustrated in FIG. 4A.
Figure 4A:
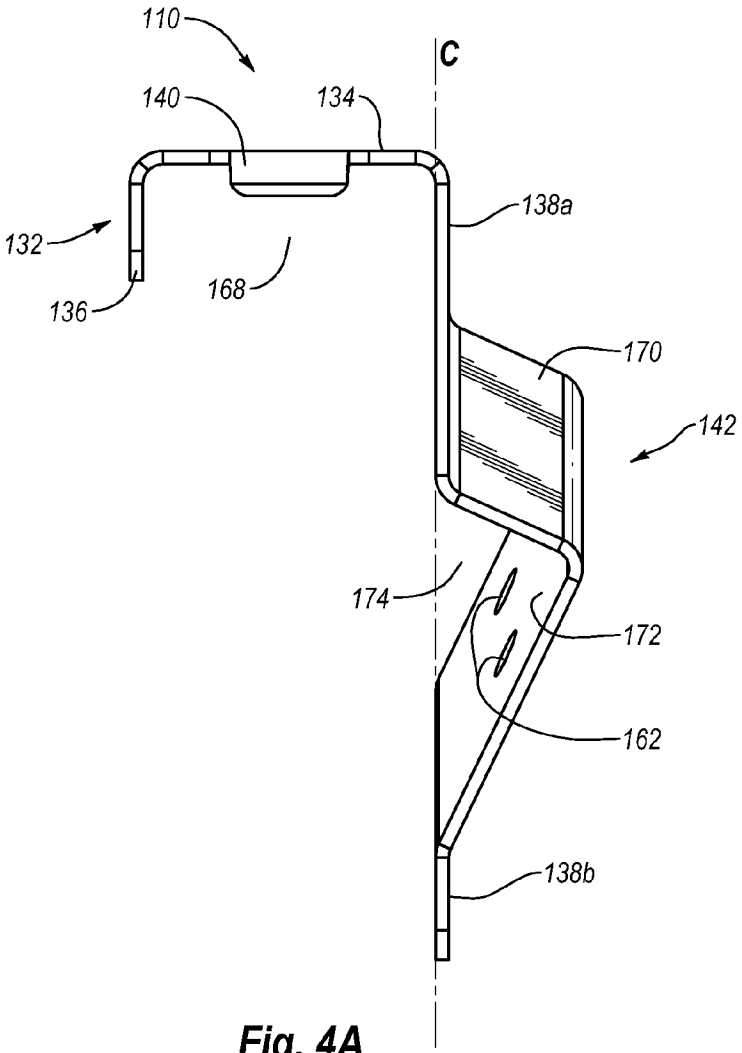
FIG. 4A illustrates a side view of the example embodiment of a door bracket within the door mount bracket assembly of FIG. 3D.

With reference to FIG. 4A, a side view of the exemplary bracket 110 is illustrated. The bracket 110 includes a door mount 132 and an exercise device mount 142. The door mount 132 includes structures for allowing the bracket 110 to be securely coupled to a door or other planar member, while the exercise device mount 142 includes structures for allowing the bracket 110 to securely couple to one or more pulleys, one or more tension members, or some other device associated with an exercise system.

In the particular embodiment in FIG. 4A, the door mount 132 is formed by multiple engagement structures designed to contact corresponding surfaces or other portions of a door. The engagement structures are, in one embodiment, formed as flat plates, although in other embodiments other types of plates, surfaces, or configurations may be used. In this particular example, the bracket 110 is formed from at least one flat plate that defines a four engagement structures 134, 136, 138, 140.

The first engagement structure 134 of the bracket 110 is a generally horizontal surface or plate and is configured to engage an upper or lower edge surface of a door. Accordingly, according to some example embodiments, a transverse width of the first engagement structure 134 corresponds generally to a thickness of a door. As shown in FIG. 4A, a second engagement structure 136 is coupled to a longitudinal edge of the first engagement structure 134, although the second engagement structure 136 may be otherwise oriented or coupled relative to the first engagement structure 134. In this embodiment, the second engagement structure 136 is configured to engage and contact a rear door surface. The second engagement structure 136 of this embodiment is thus generally parallel to a rear door surface, and generally perpendicular to the first engagement structure 134.

A third engagement surface is also illustrated, and includes two contact portions 138*a*, 138*b*. The first and second contact portions 138*a*, 138*b* are each adapted to engage and contact a front surface of a door, and thus also are generally perpendicular to the first engagement structure 134 so as to extend about parallel to the front surface of the door. In one aspect, the first contact portion 138*a* of the third engagement structure is connected to, and extends perpendicularly from, the first engagement structure 134. Accordingly, the first engagement structure 134 may be considered a medial or intermediate structure as the first engagement structure 134 is disposed between the second engagement structure 136 and the first contact portion 138*a* of the third engagement structure. The second and third engagement structures 136, 138 extend along longitudinal edges of the first engagement structure 134, and may thus also be generally considered side structures. As the second and third engagement structures 136, 138 of this embodiment extend longitudinally along the width of a door, second and third engagement structures 136, 138 may also be considered lateral engagement structure. Inasmuch as the first engagement structure 134 of this embodiment extends longitudinally along a top or bottom surface of a door, the first engagement structure 134 may also be considered a top or bottom engagement structure. Relative terms such as "top" or "bottom" are used merely for convenience and, as used herein, may refer to the first engagement structure 134; however, it should be appreciated that such terminology does not require that the first engagement structure 134 be mounted to a particular one of a top or bottom edge surface of a door or other structure.

The second contact portion 138*b* of the third engagement structure is separated from the first contact portion 138*a*. The second contact portion 138*b* is also, in this embodiment, generally aligned with the first contact portion 138*a*, so as to also contact the front surface of the door. For instance, FIG. 4A illustrates an axis C along which the first and second contact portions 138*a*, 138*b* of the third engagement structure are oriented. In this embodiment, the axis is vertical and corresponds to an edge between a front surface and a side edge surface of a door.

The exercise device mount 142 of bracket 110 is at least partially disposed between the first and second contact portions 138*a*, 138*b*. More specifically, the exercise device mount 142 in FIG. 4A includes two device mount structures 170, 172, as well as the first and second contact portions 138*a*, 138*b*. The first device mount structure 170 is connected to, and extends from, the first contact portion 138*a* of the third engagement structure. The second device mount structure 172 is connected to, and extends from, the first device mount structure 170 and the second contact portion 138*b* of the third engagement structure.

The first and second device mount structures 170, 172 are disposed at a predetermined angle relative to the third engagement structure 138. For example, FIG. 4A illustrates a side view of the bracket 110 in which the first device mount structure 170 extends in a transverse direction away from the channel 168, and at an obtuse angle relative to the first contact structure 138*a*. For instance, the angle between the first device mount structure 170 and the first contact structure 138*a* may range between about ninety and about one hundred sixty degrees. Alternatively, the angle may range between about one hundred and about one hundred thirty degrees. In yet another embodiment, the angle may range between about one hundred ten degrees and about one hundred twenty degrees. In yet other embodiments, the first device mount structure 170 may be about perpendicular to the first contact portion 138*a*.

The second device mount structure 172 is also be disposed at a predetermined angle relative to the third engagement structure 138 and/or the first device mount structure 170. For instance, second device mount structure 172 may extend from the first device mount structure 172 and in a transverse direction towards the channel 168. The angle between the second device mount structure 172 and the second contact portion 138*b* may range between about ninety and about one hundred seventy degrees. Alternatively, the angle may range between about one hundred twenty degrees and about one hundred seventy degrees. In yet another embodiment, the angle may range between about one hundred fifty degrees and about one hundred sixty degrees. Similarly, the angle between the second device mount structure 172 and the first device mount structure 170 may also vary. For instance, the angle between the second device mount structure 172 and the first device mount structure 170 may range between about thirty and about one hundred sixty degrees. In another embodiment, the angle may range between about sixty and about one hundred twenty degrees. In yet another embodiment, the angle between the second device mount structure 172 and the first device mount structure 170 may range between about seventy-five and about one hundred ten degrees. In still another embodiment, the first device mount structure 170 may be about perpendicular to the second device mount structure 172.

The various plates, surfaces, structures, and other components of the bracket 110 in FIG. 4A define multiple channels. In particular, at least first and second channels 168, 174 are defined in the illustrated embodiment. The first channel 168 generally defines a door channel in which a door may be received and secured. The second channel 174 defines, in some embodiments, an attachment or mounting channel. The second channel 174 is generally adjacent the first channel 168, and can be positioned to receive connectors, fasteners, or other components. By way of illustration, a set of connectors 160, 164 may be used to couple a pulley coupling 130 to the bracket 110 (see FIG. 3D). The connectors 160, 164 may be at least partially positioned within the second channel 174. The second channel 174 provides an opening into which connectors or other components are received. The connectors are maintained in the second channel 174 and out of the first channel 168. As a result, when the bracket 110 is coupled to a door, the connectors or other components are maintained out of engagement with the door surfaces, so as to avoid damaging the door.

A longitudinal axis of the second channel 174 is not parallel relative to a longitudinal axis of the first channel 168. The second channel 174 does not extend longitudinally parallel to the top or bottom edge surfaces of a door to which the bracket 110 is attachable. For instance, the first channel 168 has a generally rectangular cross-sectional shape and extends longitudinally along a longitudinal axis of the first engagement structure 134. A fourth engagement structure 140 extends from the first engagement structure 134 and at least partially bounds the first channel 168 at one end. For instance, the fourth engagement structure 140 generally perpendicular to the first engagement structure 134 and arranged to engage a side edge surface of a door. The fourth engagement structure 140 acts as a stop structure or plate that controls lateral movement of the bracket 110 in at least one direction parallel to the longitudinal axis of the first engagement structure 134.

The second channel 174 is shown as having a generally triangular shape. The triangular shape is defined by the intersection between the first and second channels 168, 174, and the first and second device mount structure 170, 172. The second device mount structure 172 also includes receptors 162. The receptors 162 are used to facilitate mounting a pulley and/or pulley coupling to the bracket 110. In some embodiments, the pulleys are mounted in an orientation corresponding to the angled orientation of the second device mount structure 172 relative to the first engagement structure 134. Thus, in FIG. 4A, in which the second device mount structure 172 is inclined relative to the axis C, attached pulleys may extend along an axis that is non-perpendicular and non-parallel relative to a side edge surface of a door. As noted herein, the angle of the second device mount structure 172 may be varied in any number of manners. In some embodiments, the second device mount structure 172, and thus the pulleys and/or the second channel 174, are oriented to be non-perpendicular and non-parallel relative to the axis C.

The second channel 172, as illustrated in FIG. 4A, is shown at a slight perspective view. As described herein, particularly with reference to FIG. 4C, the perspective view on the second channel 174 is the result of the second channel 174 extending in a direction that is non-parallel relative to the longitudinal axis of the top surface of a door and/or the longitudinal axis of the first engagement structure 134 of the bracket 110. In particular, the first device mount structure 170, second device mount structure 172, receptors 162, and/or pulley coupling 130 (see FIG. 3D) extend or are otherwise be oriented along one or more axes that are inclined and non-parallel and non-perpendicular relative to the longitudinal axis of the first engagement structure 134. Such incline results, in this embodiment, in one or more pulleys or tension members being directed by the bracket 110 at an angle and diagonally relative to a front door surface, rather than in a direction that is merely perpendicular or parallel to the horizontal or vertical surfaces of a door on which the bracket 110 is mounted.

FIG. 4B, illustrates a perspective view of the bracket 110 of FIG. 4A. In the bracket 110, the second channel 174 is in an inclined or angled orientation. Such orientation results from one or more components or structures of the exercise device mount 142 extending at an angle relative to a longitudinal axis of the first engagement structure 134. In this particular embodiment, the first engagement structure 134 includes two longitudinal edges 176, 178. The second engagement structure 136 extends from and along the first longitudinal edge 176, while the third engagement structure 138 extends from and along the second longitudinal edge 178 of the first engagement structure 134. The fourth engagement structure 140 extends from and along a first transverse edge 180 that extends between the first and second longitudinal edges 176, 178 of the first engagement structure 134.

The second channel 174 is inclined relative to the first engagement structure 134. In particular, in the illustrated embodiment, the second channel 174 extends in a direction that is non-parallel and non-perpendicular relative to the first engagement structure 134 and the first and second longitudinal edges 176, 178 of the first engagement structure 134. The incline of the second channel 174 may be the result of the third engagement structure 138 and/or the first and second device mount structures 170, 172 being inclined relative to the first engagement structure 134. For instance, in FIG. 4B, the longitudinal edges 182, 184, 186 of the first and second device mount structures 170, 172 are non-parallel relative to the second longitudinal edge 178.

Figure 4C:
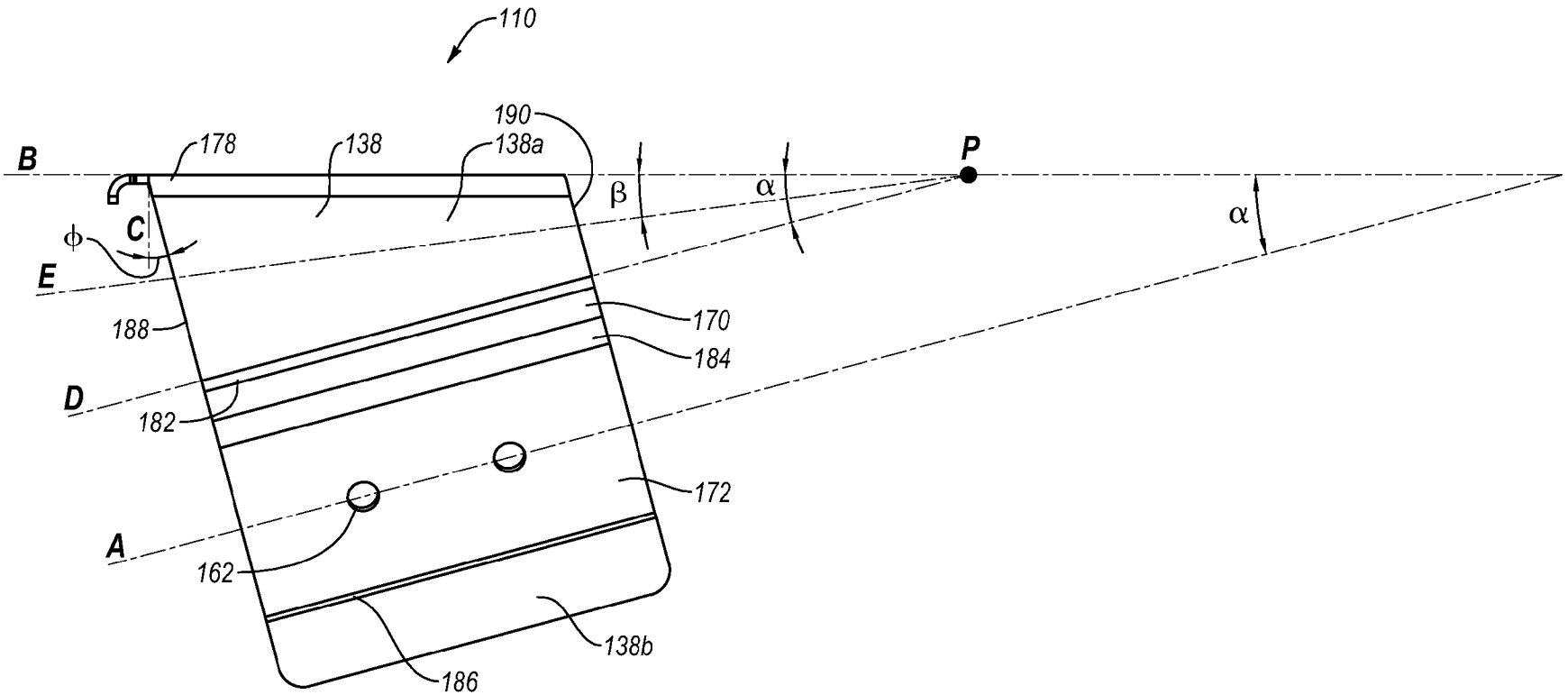
FIG. 4C illustrates a front view of the example embodiment of a door bracket illustrated in FIG. 4A.

A more particular illustration of the orientation of the longitudinal edges 182, 184, 186 is shown in FIG. 4C, which provides a side view of the bracket 110. In FIG. 4C, the third engagement structure 138 extends from the second longitudinal edge 178 of the first engagement structure 134 (FIG. 4B). In this embodiment, the third engagement 138 structure includes a first contact portion 138*a* having transverse edges 188, 190 of different lengths. In particular, the length of the first transverse edge 188 is larger than the length of the second transverse edge 190. The first and second transverse edges 188, 190 are also generally parallel, such that the first contact portion 138*a* has a generally trapezoidal shape. In other embodiments, the first and second transverse edges 188, 190 are not generally parallel. In still other embodiments, the second transverse edge 190 may be shortened or eliminated such that the first contact portion 138 has a generally triangular shape.

The longitudinal edge 182 connects the distal ends of the transverse edges 188, 190 of the first contact portion 138*a* of the third engagement structure. Because the first and second transverse edges 188, 190 extend from a common longitudinal edge 178 and have different lengths, the longitudinal edge 182 is inclined with respect to the longitudinal edge 178 of the first engagement structure 134. In some embodiments, the longitudinal edge 178 of the first engagement structure 134 is parallel to a longitudinal axis B along which the first engagement structure 134 extends. As a result, the longitudinal edge 182 between the third engagement structure 138 and the first mount surface 170 is inclined with respect to the axis B. As shown in FIG. 4C, for instance, the axis D extends along the longitudinal edge 182 and is inclined relative to the axis B.

The degree to which the longitudinal edge 182 is inclined with respect to the longitudinal axis B can vary on a variety of different factors. For instance, the first transverse edge 188 of the third engagement structure 138 may be inclined with respect to a vertical axis C. The angle between axis C and the first transverse edge 188 defines an angle $\phi$. The angle $\phi$ may range between about zero and about forty-five degrees. In another embodiment, the angle $\phi$ may range between about five and about thirty degrees. In still another embodiment, the angle $\phi$ may range between about twelve and about twenty-five degrees.

The length of the longitudinal edge 178 and the relative difference in lengths between the first and second transverse edges 188, 190 of the third engagement surface 138 also influences the degree to which the longitudinal edge 182 is inclined with respect to the longitudinal axis B. For instance, where the first and second transverse edges 188, 190 have the same length and are inclined at a same angle relative to the axis C, the longitudinal edge 182 would be parallel to the longitudinal axis B. A second transverse edge 190 that is shortened relative to the length of the first transverse edge 188 will, however, cause the longitudinal edge 182 to extend along an axis defining an angle relative to the longitudinal axis B. The defined angle may be less than ninety degrees. For instance, in the illustrated embodiment, the relationship between the lengths of the longitudinal edge 178 and transverse edges 188, 190 cause the longitudinal edge 182 of the first mount structure 170 to extend along an axis D that intersects the axis B at an angle α. Angle α in FIG. 5C is about fifteen degrees.

As shown in FIG. 4C, the first and second mount structures 170, 172 are generally regular and have parallelogram shapes. Accordingly, the longitudinal edges 184, 186 of the second mount structure 172 may also be generally parallel to the longitudinal edge 182. Consequently, axes extending through the longitudinal edges 184, 186 also intersect with the longitudinal axis B at an angle α of about fifteen degrees.

As discussed herein, pulleys 112 (FIG. 3B), tension members, other devices, or a combination thereof, may be mounted to at least the second mount structure 170 in any suitable manner. In one embodiment, pulleys 112 or other devices are mounted along, or are otherwise parallel to, the longitudinal axis A, which passes through the receptors 162. Axis A is parallel to axis D and the longitudinal edge 182, although it need not be so oriented. Where axis A and axis D are parallel, axis A is also inclined relative to axis B at an angle α of about fifteen degrees.

In the example above, the angle α is about fifteen degrees. It should be appreciated that this is merely one example, and angle α, or the angle at which the exercise device mount 142 extends diagonally across a front door surface can be different than about fifteen degrees. For example, a standard door may measure approximately thirty-one and a half inches wide by approximately eighty one inches high. For such a door, the angle formed between a side edge surface and a diagonal extending between opposing corners is approximately twenty-one degrees. Accordingly in another example, the angle α may be between about ten and about thirty-five degrees, although a larger or smaller angle α may also be formed. In still another embodiment, the angle α ranges between about twelve and about twenty-five degrees.

Furthermore, while the longitudinal edges 182, 184, 186 may each extend along generally parallel axes, this is merely exemplary. In other embodiments, edges may extend along axes that vary with respect to each other and/or relative to the longitudinal axis B. Accordingly, in another aspect, the structure connected directly or indirectly to the longitudinal edge 178 of the first engagement structure 134 may be defined at least partially with respect to a bisecting axis. For instance, FIG. 4C illustrates a bisecting axis E that passes through the midpoints of first and second transverse edges 188, 190. As shown in FIG. 4C, the bisecting axis E is inclined at an angle β relative to the longitudinal axis B. The angle β in the illustrated embodiment is about half of the angle α. Accordingly, the bisecting axis E, the longitudinal axis B, and the longitudinal axis D along the longitudinal edge 182 intersect at a point P.

Any or all other structure of the bracket 110 may also be defined in terms of a bisecting axis. The axis A extending through the receptors 162 may, for instance, bisect the second mount structure 172, although the receptors 162 do not need to be oriented along a bisecting axis. In this embodiment, inasmuch as the second mount structure 172 has transverse edges of equal length, the bisecting axis A extends parallel to longitudinal edges 184, 186 of the second mount structure 172. In other embodiments, the receptors 162 do not extend along an axis parallel to the longitudinal edges 184, 186 of the second mount structure 162, or parallel to the bisecting axis A.

In lieu of defining the bracket 110 according to the intersection of various axes, the bracket 110 may also be described in terms of one or more planes that extend along surfaces of the bracket 110. For instance, a plane extending along a plane or surface of the first engagement structure 134 may be oriented in direction that is generally parallel to the axis B, or a plane in which the first engagement structure 134 is oriented. A plane extending along the first or second mount structures 170, 172 may also extend at least partially in a lateral direction, and towards the plane of the first engagement structure 134. Such planes may intersect at one or more angles. In some embodiments, the planes defined by the structures intersect at angles generally corresponding to the illustrated angles between the axis B and the longitudinal edges and/or the bisection axes of the third engagement structure 138 and the first and second mount structures 170, 172.

The bracket 110 may be produced in any number of different manners. According to one example embodiment, the bracket 110 is integrally formed from a single plate or sheet of material. For instance, a press may be used to punch or cut the sheet of material into a predetermined shape. That shape may then be bent using any number of different bending tools or dies to produce a the bracket 110 having a predetermined or desired shape.

Figure 4D:
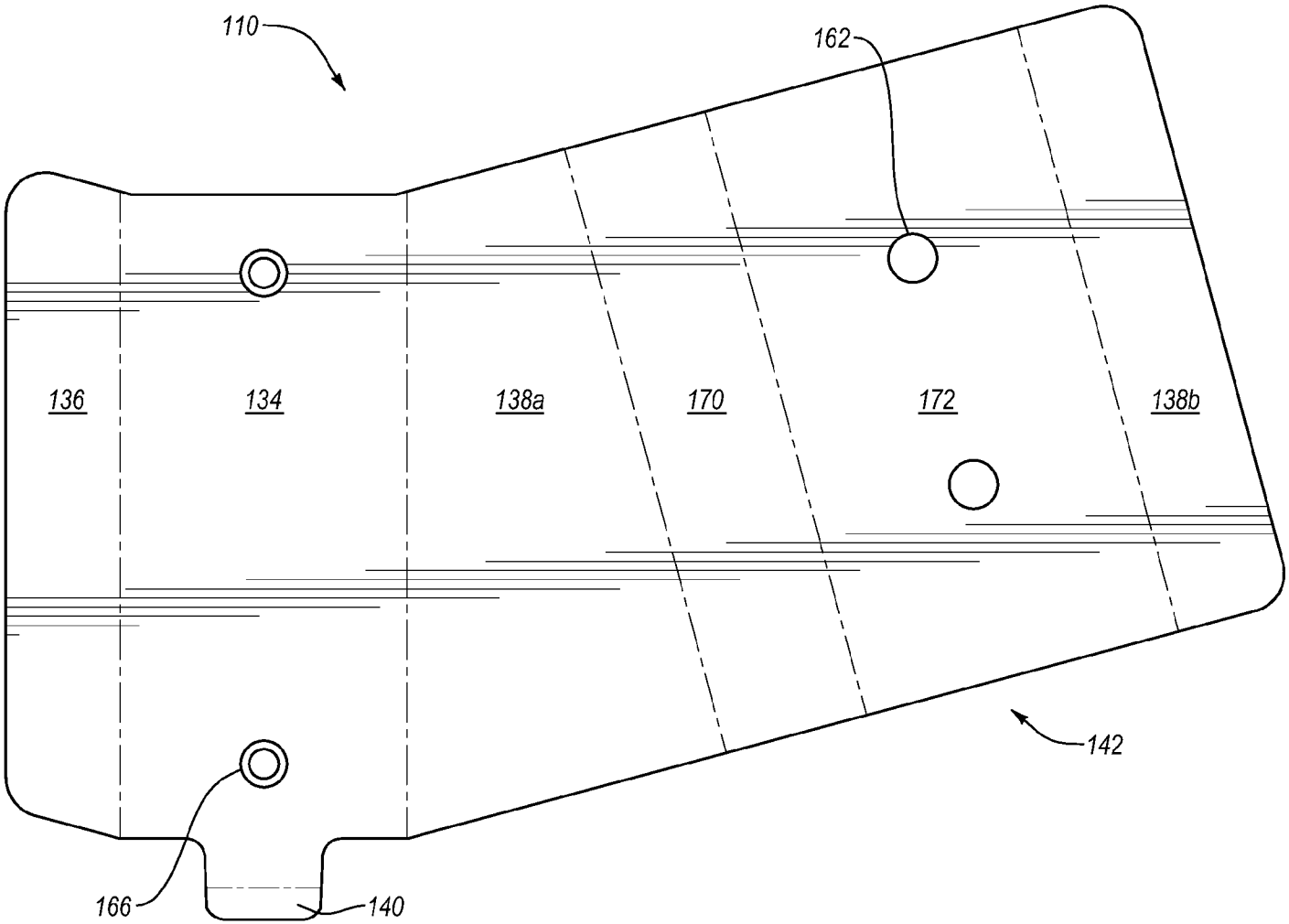
FIG. 4D illustrates an integral plate cut-out that may be assembled to form the example embodiment of a door bracket illustrated in FIGS. 4A-4C.

FIG. 4D, for instance, shows the bracket 110 prior to assembly. In particular, the bracket 110 has been cut into a predetermined shape, and has not yet been bent or otherwise molded to form the various plates and surfaces shown in FIG. 4C. The flat sheet from which the bracket 110 is formed may be passed into a bending machine that is configured to bend the sheet at different angles along the illustrated bend lines (shown in dotted lines). In bending the bracket 110 at such lines, the previously illustrated and described structures 134, 138*a*, 138*b*, 140, 170 and 172 can be formed, and can be angled with respect to each other as described herein.

It should be appreciated in view of the disclosure herein that a bending or other manufacturing process may include deviations from a desired design. For instance, while a bracket 110 may be designed to include approximately a ninety degree bend between the first engagement structure 134 and the second, third, or fourth engagement structures 136, 138, 140, or any combination thereof, a selected manufacturing process may result in some deviation. For instance, one or more of the engagement structures 136, 138, 140 may be bent at an angle greater or less than ninety degrees. Thus, a design may call, for example, for the third engagement structure 138 to be oriented perpendicular to the first engagement structure 134, but during manufacture the angle may vary from perpendicular by up to ten or more degrees. In other embodiments, one or more of the engagement structures 136, 138, 140 may be designed to be bent more or less than ninety degrees relative to the first engagement structure 134. Accordingly, no specific angle between structures should be required based on the disclosure herein, unless expressly claimed, and even in such event, should encompass deviations to be expected during manufacturing processes.

As also shown in FIG. 4D, the bracket 110 is formed to also include one or more other features. For instance, two receptors 162 are optionally formed on the second device mount structure 172. Additionally, two securement apertures 166 are also optionally formed in the first engagement structure 134 that is configured to engage a top or bottom edge surface of a door. The securement apertures 166 are sized and otherwise configured to allow a screw or other device to be inserted therein and secured to the top or bottom edge surface of the door. Such inserted devices may allow the bracket 110 to further resist lateral forces that are applied due to the diagonal orientation of the exercise device mount 142 relative to a door. In some embodiments, the securement apertures 166 are tapered or countersunk to allow a screw or other securement device placed therein to be at a position that reduces or eliminates engagement with a door frame. The location, configuration, and number of receptors 162 and securement apertures 166 are merely exemplary. More or fewer receptors 162 and/or apertures 166 may be included.

With regard to the exercise device mount 142, it will be appreciated in view of the disclosure herein that any number of features or components may be included within the exercise device mount 142. For instance, the exercise device mount 142 includes the second mount structure 172 in which the receptors 162 for mounting the pulleys or other exercise devices are located. The exercise device mount 142 also includes the first mount structure 170. Such mount structure 170 facilitates defining a channel, for example, that allows receipt of pulley connectors, or can facilitate angling of the second mount structure 172 at a desired orientation relative to a door and/or the edges of the first engagement structure 134.

The first contact portion 138*a* may also be part of the exercise device mount 142 of the bracket 110. More particularly, while pulleys may not directly connect to the first contact portion 138*a*, the first contact portion 138*a* can be used to at least partially define the axis along which the pulleys are mounted, as well as the angle of that axis. For instance, as described herein, the first contact portion 138*a* has transverse edges of differing lengths. The differing lengths may result in a longitudinal edge 182 being formed at angle that is neither perpendicular nor parallel to the first engagement structure 134. The first and second mount structures 170, 172 and receptors 162 are in this embodiment also oriented along axes that are parallel to the longitudinal edge 182 of the third engagement structure 138. Consequently, the orientation of the mounted pulleys, tension members, or other devices is at least partially resultant from the angled orientation of the third engagement structure 138.

Additionally, other components that are integrally formed with, or otherwise connected to, the bracket 110 may form all or a portion of the exercise device mount 142. For instance, the pulley coupling 130 and/or connectors 160, 164 (FIG. 3D) may be attached to the bracket 110, and form at least a part of the exercise device mount 142. In some embodiments, for instance, the pulley coupling 130 may be integrally formed as a portion of the exercise device mount 142 and used to direct the pulleys and/or tension members at a diagonal across a front surface of a door. By way of illustration, a bracket may be generally square to define axes that are parallel or perpendicular relative to the door. The pulley coupling 130 may, however, be angled to direct the tension members diagonally across the front surface of the door. In still another embodiment, a generally square bracket may have receptors 162 formed at an angle to direct tension members diagonally across the front surface of the door.

Industrial Applicability

The bracket 110, door mount assembly 106, and exercise system 100 described herein can be securely coupled to a door. Moreover, such devices, assemblies, and systems can withstand laterally directed forces without becoming inadvertently displaced or dislodged from the door to which they are attached. This may be achieved by using a bracket 110 that while maintaining a diagonal orientation relative to at least some of the surfaces or edges of a door, also counteracts lateral forces encountered as a result of the diagonal orientation. For example, the bracket 110 is mountable directly to a corner of a door, and extends at least partially along front, rear, and side edge surfaces of the door, as well as along a top or bottom edge surface of the door. An exercise device mount 142 included within, or attached to, the bracket 110 is at least partially inclined in a direction that is non-parallel and non-perpendicular relative to the top surface of the door, and thus diagonally oriented relative to the front door surface. A pulley, tension member, or other device attached to the exercise device mount 142 may then extend in a corresponding diagonal direction across the front surface of the door.

In extending an exercise device or member in a diagonal direction, a user is granted the ability to make full use of the door surface. For instance, a user may want to perform simultaneous or alternating exercises with both arms. Where opposing door mount systems are attached in opposite, diagonal directions across a door, a handle 120 (FIG. 1) may be available at two corners of the door. The lateral distance between the handles corresponds generally to the width of the door. The user may then be able to perform any of numerous different types of exercises and may use the largest range of motion that the door provides, so as to encounter little or no reduction in arm span to accommodate the position of the handles 120. Similarly, where an ankle band 122 (FIG. 1) is connected to one or more door mount systems, leg or arm exercises may be performed.

In some aspects, mounting the bracket 110 to a door includes placing the bracket 110 in contact with four door surfaces. For instance, in addition to contacting front and rear surfaces, as well as a top or bottom edge surface of the door, the bracket 110 contacts a side edge surface of the door. The engagement between the bracket 110 and the side edge surface of the door facilitates stability of the bracket 110 when used in an exercise system. For instance, the bracket 110 may be directly or indirectly coupled to one or more tension members extending diagonally across a front surface of the door. When the user pulls on a handle 120 or other mechanism to increase the tension in the tension member, the force is transferred to the bracket 110. More particularly, the force on the bracket 110 is generally aligned towards a center of the door and along an axis corresponding to the diagonal orientation of the stressed tension member. The diagonal loading on the bracket 110 includes a lateral component extending in a horizontal direction parallel to the width of the door. By including the fourth engagement structure 140 to engage the side edge surface of the door, the bracket 110 contacts the door and the door exerts an equal and opposite lateral force on the fourth engagement structure 140 of the bracket 110. The bracket 110 then remains in place instead of sliding across a top or bottom surface of the door, and instead of placing a shear force on connectors that may be securing the bracket 110 in place using securement apertures 166. Indeed, in some embodiments, a tension member extending diagonally is in a partially stressed state when the bracket 110 is secured to the door (e.g., when two brackets 110 are secured at opposing corners of the door). As a result, a tension member extending between the brackets 110 exerts a force that stabilizes the brackets 110 at their positions on corners of the door.

One feature of the present disclosure is thus an exercise system that includes a door bracket for directing tension or other members diagonally across a face of a door. The bracket 110 disclosed above is merely one example of a bracket that may direct tension or other member in such a manner, and it will be appreciated in view of the disclosure herein that any number of different type and configurations of brackets may be designed to accomplish the same. Accordingly, the discussion as it relates to bracket 110 is merely exemplary and is not limiting of the present disclosure.

Figure 5B:
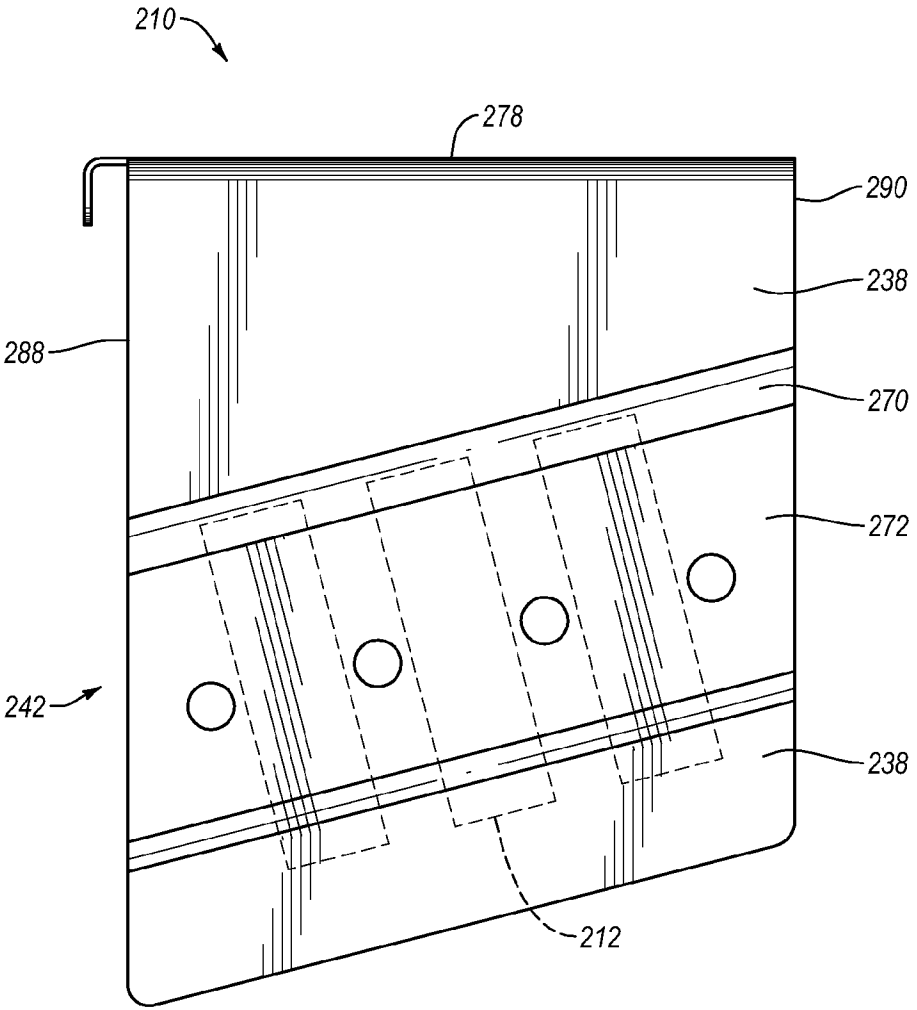
FIG. 5B illustrates a front view of the example embodiment of a door bracket illustrated in FIG. 5A.
Figure 5A:
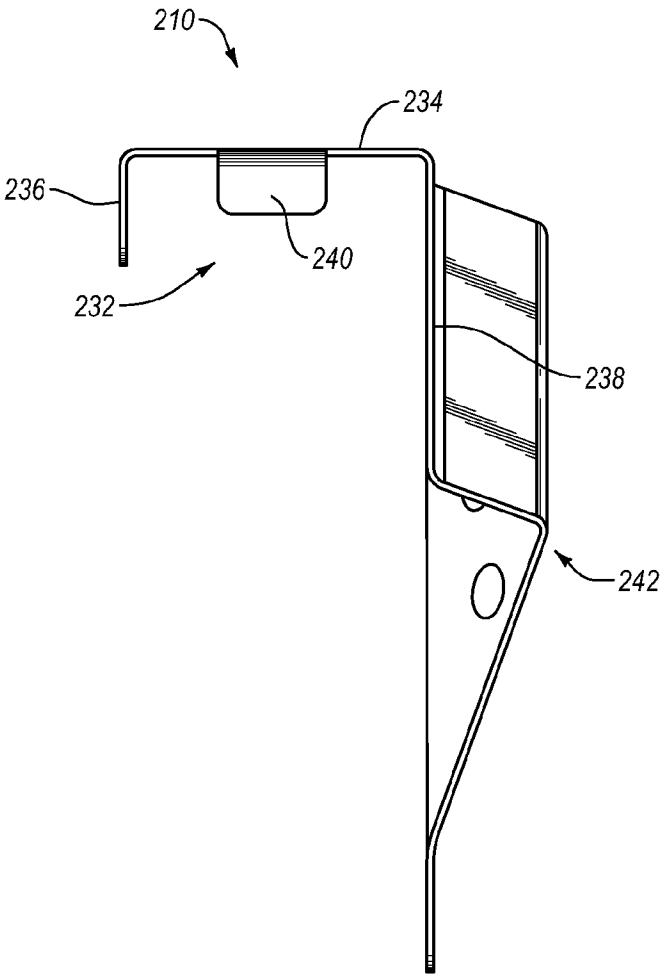
FIG. 5A illustrates a side view of a door bracket according to another example embodiment of the present disclosure.

FIGS. 5A and 5B illustrate an alternative embodiment of a bracket 210 that may also be used in accordance with the aspects disclosed herein. The bracket 210 is coupled directly or indirectly to one or more pulleys 212, tension members, or other devices, or a combination of the foregoing, and directs such devices diagonally across a front door surface of a door attached to the bracket 210.

As will be appreciated, the bracket 210 is similar in various regards to the bracket 110 (FIG. 4A) described herein. For instance, the bracket 210 includes a door mount 232 that is sized and arranged to receive a door and engage the door by contacting four surfaces of the door. The door mount 232 is at least partially defined by four engagement structures 234, 236, 238, 240.

The bracket 210 also includes an exercise device mount 242 that can be used to mount pulleys 212, tension members, or other devices to the bracket 210. As shown in FIG. 5B, the exercise device mount 242 includes two mount structures 270, 272 extending between portions of a door engagement structure 238. The mount structures 270, 272 are inclined. For instance, the mount structures 270, 272 extend in transverse directions and are inclined relative to a vertical axis of the front surface of a door, as best illustrated in FIG. 5A. Additionally, or alternatively, the mount structures 270, 272 extend longitudinally in a direction that is inclined relative to a longitudinal edge 278 of a first engagement structure 234, as best shown in FIG. 5B. The angle between the longitudinal edge 278 and longitudinal axes of the mount surfaces 270, 272 may be varied. In one embodiment, such angle is configured to direct pulleys 212 at an incline relative to the front surface of a door, such that tension members operating with the pulleys 212 are directed diagonally across the front surface of the door.

As will be appreciated from the view of the bracket 210 shown in FIG. 5B, the transverse edges 288, 290 of a third engagement structure 238 are parallel. The transverse edges 288, 290 are also parallel to an axis of a side edge surface of a door to which the bracket is attached. Having transverse edges 288, 290 parallel to the side edge surface of a door may be distinguished from the transverse edges 188, 190 of the bracket 110 illustrated in FIG. 3C. It will be appreciated that a bracket according to the present disclosure may thus include parallel or inclined transverse edges of one or more structures or plates defining a door mount and/or exercise device mount of a bracket.

Figure 6B:
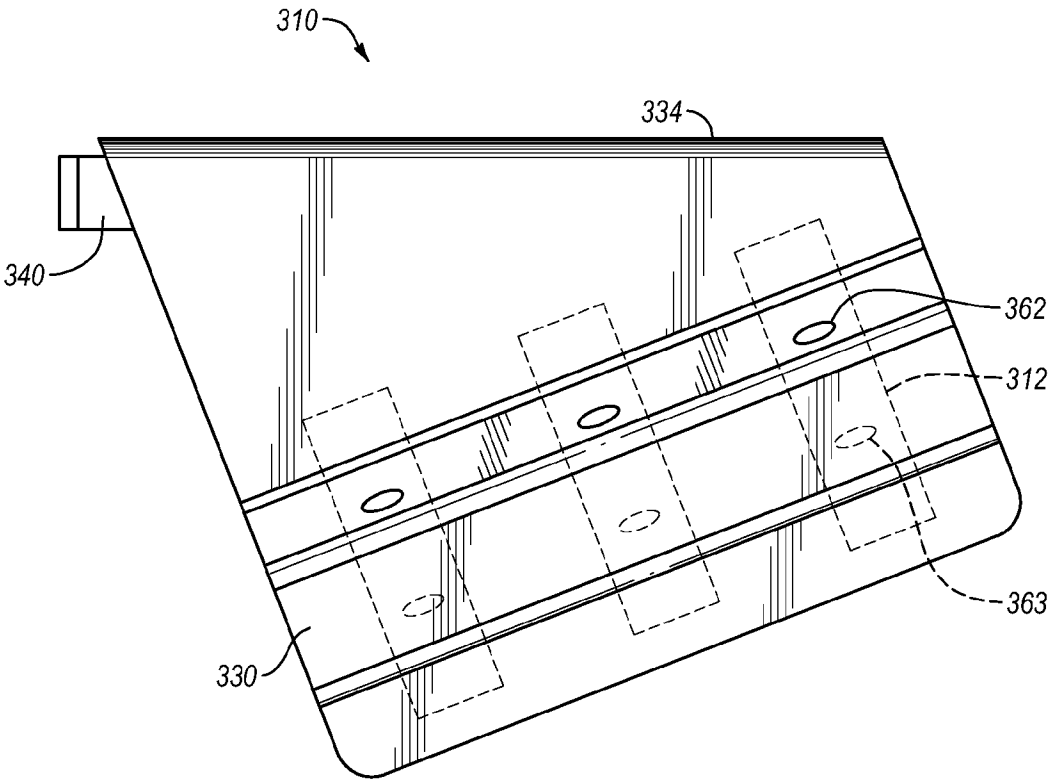
FIG. 6B illustrates a front view of the example embodiment of a door bracket illustrated in FIG. 6A.
Figure 6A:
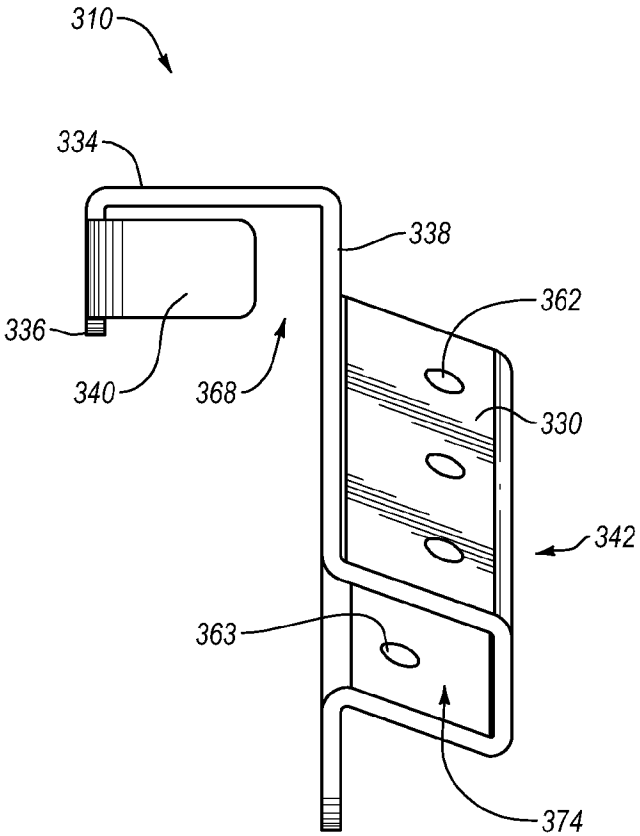
FIG. 6A illustrates a side view of a door bracket according to another example embodiment of the present disclosure.

FIGS. 6A and 6B illustrate still another example embodiment of a bracket 310 that may be used in accordance with aspects of the present disclosure. In FIG. 6A, for instance, a side view of the bracket 310 is shown and includes an exercise device mount 342. The exercise device mount 342 of this embodiment includes multiple structures, such as places, defining a pulley coupling 330. The pulley coupling 330 also includes a channel that is adjacent to a channel 368 into which a door may be positioned and coupled to the bracket 310.

The pulley coupling 330 of the illustrated embodiment is adapted to receive one or more components that couple a pulley, tension member, other device, or a combination of the foregoing to the bracket 310. For instance, as shown in FIG. 6B, one or more pulleys 312 are attachable to the bracket 310. The pulleys 312 may include, for instance, an opening into which the components of the pulley coupling 330 may be positioned. A clip, pin, bolt, other device, or a combination of the foregoing, is insertable through the receptors 362, 363 in the pulley coupling 330 to secure the pulleys 312 to the bracket 310.

FIGS. 6A and 6B thus illustrate an exemplary bracket 310 in which a pulley coupling 330 is integrally formed as part of an exercise device mount 342 of the bracket 310. Moreover, in this embodiment, the channel 374 may receive components that directly couple a pulley 312 to the bracket 310. This may be contrasted with, for example, the channel 174 of the bracket 110 in FIG. 4A. The channel 174 may, for instance, receive components that indirectly couple pulleys to a bracket 110 by coupling a pulley coupling 130 to the bracket 110. However, inasmuch as bracket 310 of FIGS. 6A and 6B includes the pulley coupling 330 integrally formed with the bracket 310, no separate coupling component may be required.

As also shown in FIGS. 6A and 6B, it is not necessary that the engagement structures 334, 336, 338, 340 be coupled together in any particular manner. For instance, in this embodiment, a fourth engagement structure 340 acting as a stop for the channel 368, and which engages a side edge surface of a door, is coupled directly to the second engagement structure 336, while the first engagement structure 334 is only indirectly coupled to the fourth engagement structure 340 by virtue of the first engagement structure 334 being coupled to the second engagement structure 336. The fourth engagement structure 340 could however, just as easily be attached to the first engagement structure 334 or the third engagement structure 338.

A bracket 310 according to this embodiment, is an angled bracket that itself extends at an incline relative to an attached door, although the bracket could also be a square door extending parallel and perpendicular to the various door surfaces, and with components configured to direct the pulleys 312 at a diagonal across the front surface of the door. As shown in FIG. 6A, the receptors 362, 363 may be formed in opposing structures of the pulley coupling 330. The receptors 362, 363 may also have an offset configuration. By way of illustration, the upper receptors 362 are offset from the channel 368 by a transverse distance that is greater than a transverse distance by which the lower receptors 363 are offset from the channel 368. In such an embodiment, the receptors 362, 363 allow a pulley 312 to be mounted along a non-vertical axis that is non-parallel relative to an edge between the front surface and side edge surface of a door. Additionally, or alternatively, the receptors 362, 363 may be laterally and/or vertically offset. In FIG. 6B, for instance, each upper receptor 362 of the pulley coupling 330 is positioned at a different horizontal and vertical position relative to the other upper receptors 362. As a result, each pulley 313 has a different distance from the top engagement structure 334 and the fourth engagement structure 340. The lower receptors 363 are configured in a manner similar to the upper receptors 362.

Upper receptors 362 are also laterally offset relative to a corresponding one of the lower receptors 363. For instance, in FIG. 6B, the pulley coupling 330 is at an incline relative to the first engagement structure 334. The upper and lower receptors 362, 363 are inclined such that a lower receptor 362 is offset a horizontal or lateral distance from the fourth engagement structure 340 by a different distance than a corresponding lower receptor 363. As a result, the pulleys 312, when mounted to the pulley coupling 330, are inclined and configured to direct a tension or other member diagonally across a front surface of a door, rather than vertically along the front surface of the door.

Figure 7B:
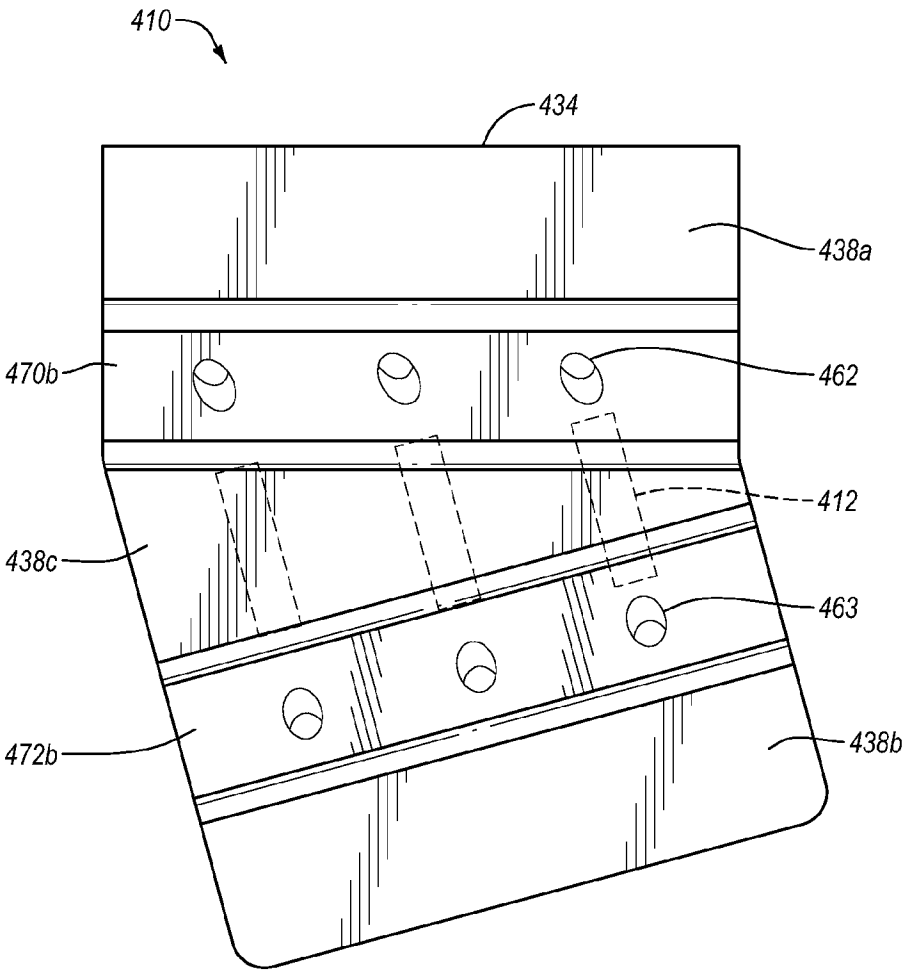
FIG. 7B illustrates a front view of the example embodiment of a door bracket illustrated in FIG. 7A.
Figure 7A:
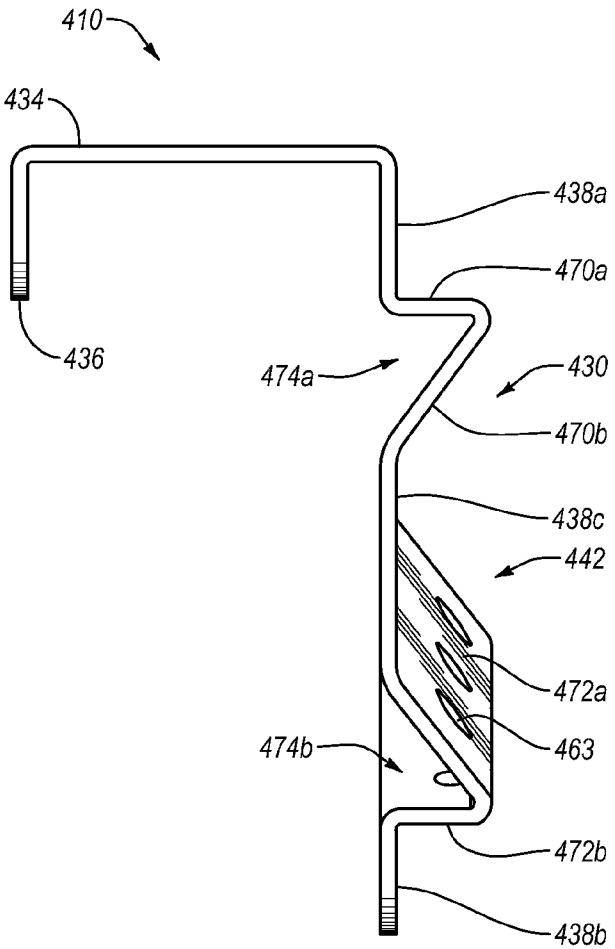
FIG. 7A illustrates a side view of a door bracket according to another example embodiment of the present disclosure.

FIGS. 7A and 7B illustrate still another exemplary embodiment of a door bracket 410 that may be used in accordance with some aspects of the present invention. The door bracket 410 includes five engagement structures 434, 436, 438*a*, 438*b*, 438*c* adapted to engage three surfaces of a door, including front and rear door surfaces and an upper or lower edge surface of the door.

In this embodiment, three of the engagement structures 438*a-c* are each configured to engage the front surface of the door. The three engagement structures 438*a-c* are separated by two channels 474*a*, 474*b*. The two channels 474*a*, 474*b* are formed as part of a pulley coupling 430 and are arranged to facilitate attachment of a pulley or other device to the bracket 410. For instance, the pulley coupling 430 includes upper and lower receptors 462, 463, as best illustrated in FIG. 7B. The upper and lower receptors 462, 463 are aligned to allow one or more pulleys to be inserted therebetween. For instance, a pulley 412 is positionable at least partially between an upper receptor 462 and a corresponding lower receptor 463. The receptors 462, 463 are in this embodiment openings defined in the exercise device mount 442. Accordingly, a pin, clamp, clip, bolt, or other type of connector may be inserted through the receptors 462, 463 and the pulley 412, thereby coupling the pulley 412 to the pulley coupling 430.

Returning to FIG. 7A, it will be appreciated that the upper receptors 462 include a set of two openings. For instance, the pulley coupling 430 includes first and second mount structures 470*a*, 470*b*. The first and second mount structures 470*a*, 470*b* are angled relative to each other, thereby defining the first channel 474*a*. The upper receptors 462 include a set of aligned openings within each of the first and second mount surfaces 470*a*, 470*b*. The aligned openings allow a pin, clip, bolt, or other fastener to be passed therethrough. The first channel 474*a* defined by the first and second mount structures 470*a*, 470*b* is sized or otherwise arranged to receive therein one or more couplings or fasteners used to secure a pulley to the bracket 410. In one embodiment, for instance, a C-clip may pass through the upper receptors 462. A nut or other retainer may be positioned within the first channel 474*a*. In other embodiments, however, a bolt, pin or other devices passes through the upper receptors 462, and a nut or other retainer, if any, is positioned external to the channel 474*a*, such as on an exterior portion of the first mount structure 470*a*.

The second receptors 463 of the pulley coupling 430 are arranged similar to the first receptors 462. For instance, the bracket 410 of FIG. 7A includes lower receptors 463 that each include two openings defined in third and fourth mount structures 472*a*, 472*b*. The third and fourth mount structures 472*a*, 472*b* are angled relative to each other, and define the second channel 474*b*, and the two openings of the lower receptors 463 are aligned and configured to receive a pin, bolt, clip, or other connector. The second channel 474*b* is also be sized or otherwise arranged to receive couplings or fasteners that secure a pulley to the bracket 410. As with the upper channel 474*a*, a coupling or fastener, if any, may pass partially or fully through the second channel 474*b*. Additional components, such as a nut or other retainer or fastener, may be housed within the second channel 474*b* or positioned external to the second channel 474*b*, and operate in connection with a fastener or coupling positioned within the second channel 474*b*.

As shown in FIGS. 7A and 7B, the channels 474*a*, 474*b* are non-parallel. For instance, in one embodiment, an engagement structure 438*c* of the exercise device mount 430 has transverse edges of different lengths. In FIG. 7B, for instance, the engagement structure 438*c* is generally trapezoidal. Indeed, the engagement structure 438*c* has a different length for each edge, although this is merely exemplary. Due to the differing transverse edge lengths, the second channel 474*b* is inclined relative to a longitudinal axis of the first engagement structure 434 and/or the first channel 474*a*. Consequently, each of the upper receptors 462 is at a different distance from a corresponding lower receptor 463. As shown in FIG. 7B, for instance, the fourth mount structure 472*b* is set at a predetermined angle relative to the engagement structure 438*a* and the second mount structure 470*b*. As a result, the pulleys 212 are also at different distances from the upper engagement structure 434 and/or the upper receptors 462.

It should be appreciated in view of the disclosure herein that the second channel 474*b* may be inclined at a predetermined angle that generally corresponds to a diagonal of a door. For instance, a longitudinal axis of the fourth mount structure 472*b* may be at an angle ranging between ten and forty-five degrees relative to a longitudinal axis of the first engagement surface 434. In some embodiments, the angle may range between twelve and twenty-five degrees. In other embodiments, the angle may be less than ten degrees or greater than forty-five degrees.

The bracket 410 is usable in an exercise system that includes tension members extending at a diagonal across a front surface of a door. For instance, the bracket 410 can be placed along a top edge surface of a door, and a similar bracket 410 may be placed along a bottom edge surface of the door. Tension members may extend between the brackets 410 and/or the pulleys 412 attached to the brackets. Optionally, the brackets 410 are mountable to the corners of the door and include edge engagement structure that act as stops on the side edge surfaces of the door. Additionally, while the two channels 474*a*, 474*b* are illustrated as being non-parallel, this is also merely exemplary. In other embodiments, for instance, the channels 474*a*, 474*b* may be parallel. By way of illustration, the positions of the engagement surfaces 438*a*, 438*c* may be swapped. As a result, the first channel 474*a* can extend at an incline relative to a top edge surface of the door, while also being generally parallel to the second channel 474*b*.

Figure 8:
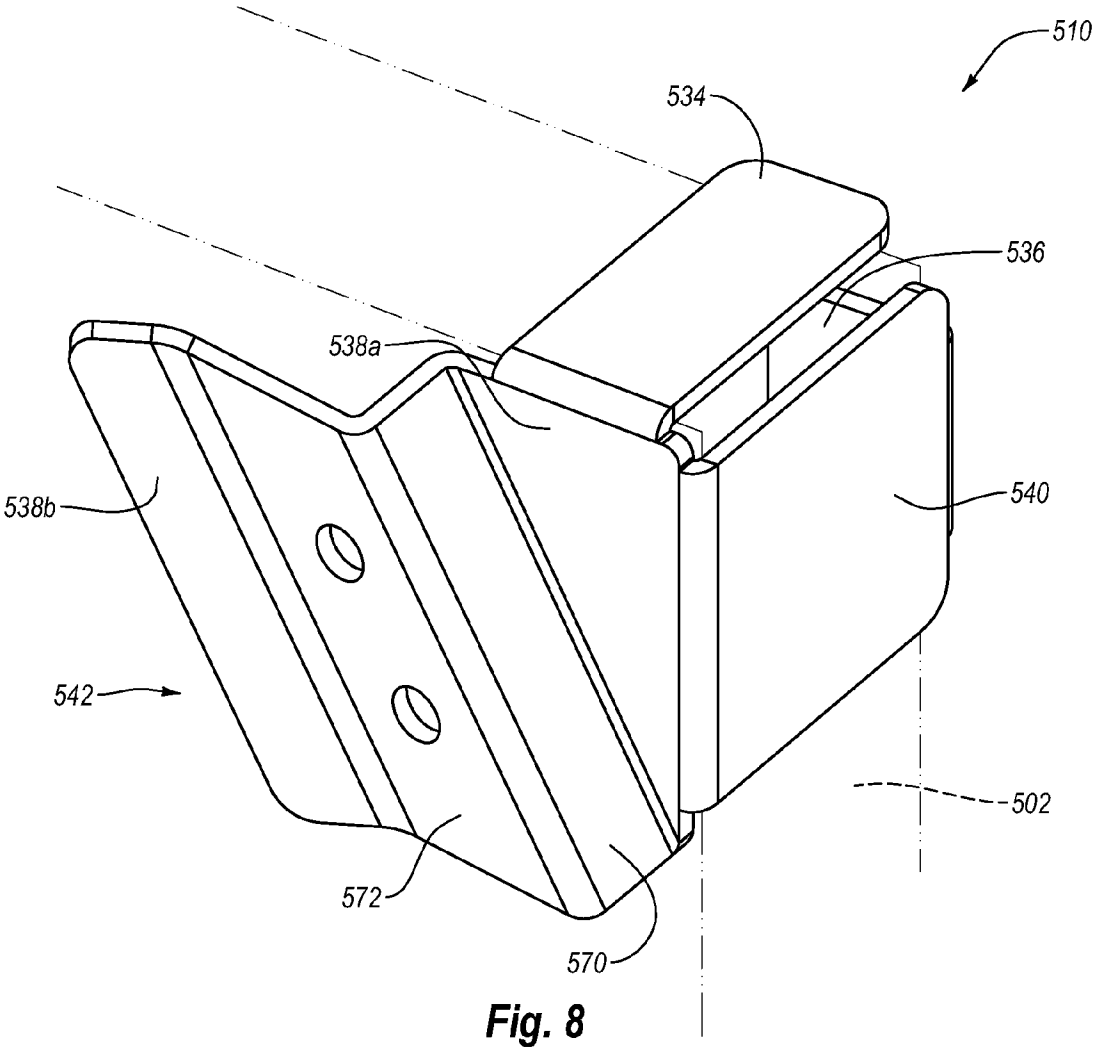
FIG. 8 illustrates a perspective view of a door bracket according to another example embodiment of the present disclosure.

FIG. 8 illustrates a perspective view of still another door bracket 510 that may be used in accordance with the exercise systems of the present disclosure to angle a tension member or other device at a diagonal across a front surface of a door 502. The door bracket 510 is a corner bracket that can connect to a corner of the door 502 and engage four surfaces of the door 502. By engaging four surfaces of the door 502, the angle bracket 510 can remain securely coupled to the door 502 when a tensile force is exerted along the diagonal. In this embodiment, a first engagement structure 534 contacts a top or bottom edge surface of the door 502. A second engagement structure 536 contacts a rear surface of the door 502, and a third structure surface—which in this includes two contact portions 538*a*, 538*b*—contacts a front surface of the door 502. A fourth structure surface 540 contacts a side edge surface of the door 502.

More particularly, the bracket 510 includes a first engagement structure 534 that contacts an upper or lower edge surface of the door 502. A first contact portion 538*a* of the third engagement structure extends from an edge of the first engagement structure 534. The first contact portion 538*a* of the third engagement structure extends in a substantially perpendicular direction relative to the first engagement structure 534. The fourth engagement structure 540 extends from an edge of the first contact portion 538*a* of the third engagement structure. The fourth engagement structure 540 is substantially perpendicular to each of the first engagement structure 534 and the first contact portion 538*a* of the third engagement structure.

Extending from an edge of the fourth engagement structure 540 is the second engagement structure 536. The second engagement structure 536 is substantially perpendicular to each of the first and fourth engagement structure 534, 540, and substantially parallel to the first contact portion 538*a* of the third engagement structure. Accordingly, the first engagement structure 534 may be referred to as a top or bottom engagement surface, the second engagement structure 536 may be referred to as a rear engagement structure, the third engagement structure may be a front engagement structure, and the fourth engagement structure 540 may be referred to as a side engagement structure, or a stop structure.

Each engagement structure 534, 536, 538*a*, 540 provides stabilizing engagement between the bracket 510 and the door 502. For instance, in the orientation and position shown in FIG. 8, if a force with a downward, vertical component is applied to the bracket 510 (e.g., through a tension member coupled to the bracket 510), the first engagement structure 534 maintains engagement with the top edge surface of the door 502 and restricts the bracket 510 from moving in a downward direction. If a rearward-directed force is applied to the bracket 510, the first contact portion 538*a* maintains engagement with the front surface of the door 502 and restricts the bracket 510 from moving towards the rear surface of the door. If a forward-directed force is applied to the bracket 510, the second engagement structure 536 maintains engagement with the door 502 and restricts the bracket 502 from moving towards the front surface of the door 502. If a lateral or horizontal force is applied to the bracket 510, the fourth engagement structure 540 maintains engagement with the side edge surface of the door 502 and restricts the bracket 510 from moving towards an opposing side edge surface of the door 502.

It will be appreciated in view of the disclosure herein that by placing the bracket 510 in engagement along four surfaces of the door 502, the bracket 510 is substantially secured in place and restricted from inadvertently being separated from the door 502. More specifically, two forces may be applied to separate the bracket 510 from the door, but generally require an intentional action on the part of the user. In the illustrated configuration, either a vertically upward directed force, or a horizontal force towards the exterior of the door 502 can remove the bracket from the door 502. In some embodiments, however, the bracket 510 may be secured to one or more tension members extending diagonally across the front surface of the door 502. Such tension members may apply a tensile force on the bracket 510. The tensile force has vertical and horizontal components. These vertical and horizontal components of the tensile force can be opposite to the forces that allow removal of the bracket 510 from the door. With sufficient force, a user may be able to overcome the internal forces the tensile members apply to the bracket 510 so as to remove the bracket 510 from the door 502; however, the internal tensile force may be sufficient to substantially prevent the bracket 510 from becoming inadvertently dislodged from the door 502. In other embodiments, one or more securement apertures may be provided in the engagement structures 534, 536, 538, 540 to resist removal forces.

As also illustrated in FIG. 8, the exemplary door bracket 510 may be configured to incline across the front surface of the door 502. The illustrated door bracket 510, for instance, includes an exercise device mount 542 that includes the first and second portions 538*a*, 538*b* of the third engagement structure. The first and second portions 538*a*, 538*b* are separated by two mount structures 570, 572. The two mount structures 570, 572 facilitate mounting of a pulley, tension member, or other device to the bracket 510. In FIG. 8, the first portion 538*a* has a generally triangular shape. An edge generally corresponding to the hypotenuse of the triangle couples the first portion 538*a* to the mount structures 570, 572, thereby allowing the first and second mount structures 570, 572 to extend from the corner of the door 502 at an angle, and at a diagonal across the front surface of the door 502. A distal longitudinal edge of the second mount structure 572 is connected to the second portion 538*b*. The second portion 538*b* is separated from the first portion 538*a* of the third engagement structure, and provides additional leverage as forces are applied to the bracket 510. The second portion 538*b* is, however, merely exemplary. In the embodiments disclosed herein, the second contact portion 528*b* may be eliminated, thereby providing only a single contact structure along the front surface of the door 502.

The particular angle at which the first and second mount structures 570, 572 extend may be varied. For instance, according to one example, the first and second mount structures 570, 572 are configured to direct coupled tension members diagonally across the front surface of the door 502 along an axis that is at an angle ranging between about five and about forty-five degrees relative to a side edge surface of the door 502. In another embodiment, the two mount structures 570, 572 direct coupled exercise elements diagonally across the front surface of the door 502 along an axis that is at an angle ranging between about ten and about twenty-five degrees relative to a side edge surface of the door 502. In other embodiments, the angle between exercise elements mounted to the two mount structure 570, 572 and the side surface of the door is less than five degrees or greater than forty-five degrees.

Figure 9:
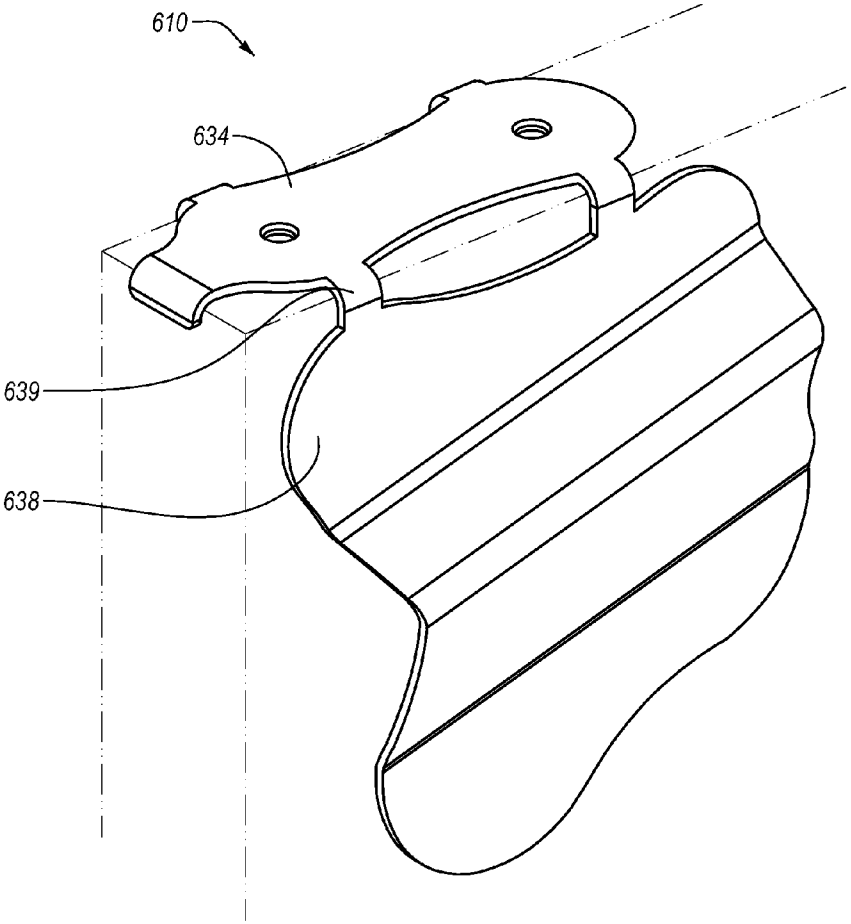
FIG. 9 illustrates a perspective view of a door bracket according to still another example embodiment of the present disclosure.

FIG. 9 illustrates still another door bracket 610 within the scope of the present disclosure. In FIG. 9, the illustrated bracket 610 includes a bottom engagement structure engaging a bottom edge surface of a door. A side engagement structure 638 is coupled to the bottom engagement structure 634 and engages a front edge surface of the door. In this embodiment, the connection between the bottom and side engagement structures 628 is performed by a set of one or more extensions 639. The extensions 639 may include flexible or rigid tethers, fingers, ties, hinges, or other components that connect the bottom and side engagement structures 634, 638 in a desired orientation. Such extensions 639 may connect to the bottom and side engagement structures 634, 638 at only discrete locations, such that voids are defined between the extensions 639. A door channel defined at least partially by the extensions 639 and the bottom and side engagement structures 634, 638, is formed to receive the door to which the bracket 610 is mounted. Thus, a door channel may be defined despite gaps existing between the various engagement structures of a door bracket.

As will be appreciated, a door-mounted exercise system according to the present disclosure may include any number of different types and configurations of door brackets and mount assemblies arranged to direct tension members diagonally across a front surface of the door. More generally then, a method for positioning a door bracket on a door may include the steps of positioning a door bracket 110 (see also 210, 310, 410, 510) in substantially simultaneous contact with at least three surfaces of a door. The surfaces contacted by the door bracket 110 can include front and rear surfaces of the door, and either a top or bottom edge surface of the door. Placing the bracket 110 in contact with the door in this manner can be accomplished by using a bracket 110 that includes a first engagement structure 134 (see also, 234, 334, 434, 534) that is optionally a top or bottom surface and/or which interposes two opposing engagement structures 136, 138 (see also, 236, 238, 336, 338, 436, 438, 536, 538). The first engagement structure 134 can be placed against the top or bottom edge surface of the door, while the engagement structures 136, 138 are placed in contact against the front and rear surfaces of the door.

Additionally, or alternatively, positioning the door bracket 110 may include orienting one or more exercise members laterally across the front surface of the door. The door bracket 110 may, for instance, include an exercise device mount 142 (see also 242, 342, 442, 542) that is attachable to, or includes, one or more tension or other exercise members. The exercise device mount 142 defines a predetermined angle relative to the door. For instance, the exercise device mount 142 may extend or otherwise be configured to direct tension members at least partially in a lateral direction relative to the first engagement surface 134 and the front surface of the door. More particularly, a longitudinal or bisection axis may extend along a top or bottom edge surface of a door or along a longitudinal edge thereof. When the exercise device mount 142 is fully or partially angled in a lateral direction relative to the first engagement surface 134, the exercise device mount 142 directs a pulley, tension member, or other exercise member in a direction at least partially parallel to the longitudinal and/or bisection axis of the top or bottom edge surface of the door. For instance, a tension member extending from a left upper corner to a lower right corner of a door extends partially in a vertical direction, and partially in a lateral direction as it extends horizontally across the front surface of a door. The exercise device mount 142 of the bracket 110 may direct a pulley, tension member, or other member in a lateral direction when only internal forces are applied (i.e., forces resulting from mounting the exercise system to the door), even in the absence of external forces (e.g., forces applied to the tension members by a user of the exercise system). Accordingly, as used herein, the term "lateral" relates to a direction that is horizontally aligned, or configured to be horizontally aligned, relative to a vertically hung door or structure. Similarly, a "lateral axis" is an axis configured to extend horizontally, and in a lateral axis, when a bracket, exercise device, or other component is mounted to a door or similar structure.

What is claimed is:

1. An exercise apparatus door mount bracket, comprising:

a door mount defining a channel, the channel extending along a first lateral axis, the channel comprising:

a base engagement structure, the base engagement structure having a width corresponding to a door thickness;

a first side structure extending about perpendicular to the base engagement structure, the first side structure configured to engage a first surface of a door; and a second side structure extending about perpendicular to the base engagement structure, the second side structure configured to engage a second surface of a door; and an exercise device mount attached to the second side structure, wherein at least a portion of the exercise device mount comprises tension members oriented at an incline angle with respect to the base engagement structure such that the tension members are oriented to direct lateral forces diagonally at an incline angle with respect to the base engagement structure.

2. The exercise apparatus door mount bracket recited in claim 1, wherein the channel further comprises a stop structure extending about perpendicular to the base engagement structure.

3. The exercise apparatus door mount bracket recited in claim 2, wherein the stop structure is about perpendicular to the first and second side structures.

4. The exercise apparatus door mount bracket recited in claim 1, wherein the door mount includes one or more plates, the one or more plates defining the base engagement structure, first side structure, and second side structure.

5. The exercise apparatus door mount bracket recited in claim 1, wherein the second side structure has opposing transverse edges of different lengths.

6. The exercise apparatus door mount bracket recited in claim 5, wherein a shape of the second side structure is generally trapezoidal or generally triangular.

7. The exercise apparatus door mount bracket recited in claim 1, wherein the second side structure includes a plate with a longitudinal edge, and wherein the longitudinal edge of the second side structure is offset at an acute angle relative to the first lateral axis.

8. The exercise apparatus door mount bracket recited in claim 1, wherein the at least a portion of the exercise device mount oriented along the second lateral axis defines a longitudinal edge that is non-parallel and non-perpendicular relative to the first lateral axis.

9. The exercise apparatus door mount bracket recited in claim 1, wherein the exercise device mount defines a second channel, the second channel being adjacent the channel defined by the door mount, the second channel being aligned with one or more receptors in the exercise device mount.

10. The exercise apparatus door mount bracket recited in claim 1, wherein the exercise device mount includes:

a first device mount structure extending from the second side structure; and a second device mount structure attached to the first device mount structure at an axis that is non-parallel and non-perpendicular relative to the first lateral axis of the channel.

11. The exercise apparatus door mount bracket recited in claim 1, wherein the door mount and exercise device mount are integrally formed from a single plate.

12. A door bracket, comprising:

a door edge engagement structure having opposing first and second longitudinal edges, wherein a distance between the first and second longitudinal edges generally corresponds to a door thickness;

a door rear engagement structure, the door rear engagement structure connected to the first longitudinal edge and extending about perpendicular to the door edge engagement structure;

a door front engagement structure extending about perpendicular to the door edge engagement structure from the second longitudinal edge to a third longitudinal edge, wherein a first bisection axis bisects the front engagement structure between the second and third longitudinal edges, the door front engagement structure including an exercise device mount surface, wherein at least a portion of the exercise device mount surface extends longitudinally along a second bisection axis, the second bisection axis being offset at an acute angle relative to the first bisection axis; and the exercise device mount comprises tension members oriented at an incline angle with respect to the base engagement structure such that the tension members are oriented to direct lateral forces diagonally at an incline angle with respect to the base engagement structure.

13. The door bracket recited in claim 12, wherein the door front engagement structure includes a door contact portion, and wherein at least one bend in the door front engagement structure separates the door contact portion and the exercise device mount surface.

14. The door bracket recited in claim 12, wherein the door front engagement structure defines a connector channel, the connector channel extending longitudinally along an axis that is at an acute angle relative to the first bisection axis.

15. The door bracket recited in claim 12, wherein the door edge, door rear, and door front engagement structures collectively define a door channel, the door bracket structure further including a stop structure about perpendicular to the door edge engagement structure and bounding one longitudinal end of the door channel.

16. The door bracket recited in claim 12, wherein the door edge, door rear, and door front engagement structures are integrally formed, and wherein the at least a portion of the exercise device mount surface has transverse edges of differing lengths.

* * * * *